US009480133B2

(12) United States Patent
Tischler et al.

(10) Patent No.: US 9,480,133 B2
(45) Date of Patent: Oct. 25, 2016

(54) LIGHT-EMITTING ELEMENT REPAIR IN ARRAY-BASED LIGHTING DEVICES

(71) Applicants: Michael A. Tischler, Vancouver (CA); Tom Pinnington, Vancouver (CA); Philippe M. Schick, Vancouver (CA); Paul Jungwirth, Burnaby (CA)

(72) Inventors: Michael A. Tischler, Vancouver (CA); Tom Pinnington, Vancouver (CA); Philippe M. Schick, Vancouver (CA); Paul Jungwirth, Burnaby (CA)

(73) Assignee: COOLEDGE LIGHTING INC., Richmond (CA)

( * ) Notice: Subject to any disclaimer, the term of this patent is extended or adjusted under 35 U.S.C. 154(b) by 428 days.

(21) Appl. No.: 13/967,828

(22) Filed: Aug. 15, 2013

(65) Prior Publication Data

US 2014/0167611 A1 Jun. 19, 2014

Related U.S. Application Data

(63) Continuation-in-part of application No. 13/183,684, filed on Jul. 15, 2011, now Pat. No. 8,653,539, which is a continuation-in-part of application No. 12/982,758, filed on Dec. 30, 2010, now Pat. No. 8,493,000, said application No. 13/183,684 is a continuation-in-part of application No. 13/171,973, filed on Jun. 29, 2011, now Pat. No. 8,384,121.

(Continued)

(51) Int. Cl.
*H05B 37/04* (2006.01)
*H05B 33/08* (2006.01)

(52) U.S. Cl.
CPC ..... *H05B 37/04* (2013.01); *H05B 33/0803* (2013.01); *H05B 33/089* (2013.01)

(58) Field of Classification Search
None
See application file for complete search history.

(56) References Cited

U.S. PATENT DOCUMENTS

| | | | | |
|---|---|---|---|---|
| 5,081,520 | A | 1/1992 | Yoshii et al. | |
| 5,408,190 | A * | 4/1995 | Wood | G01R 1/0466 257/E21.525 |
| 5,631,191 | A | 5/1997 | Durand et al. | |
| 5,918,113 | A | 6/1999 | Higashi et al. | |
| 6,249,088 | B1 * | 6/2001 | Chang | H05B 33/0821 315/185 R |
| 6,281,450 | B1 | 8/2001 | Urasaki et al. | |
| 6,357,889 | B1 | 3/2002 | Duggal et al. | |
| 6,478,909 | B1 | 11/2002 | Tuttle | |
| 6,501,102 | B2 | 12/2002 | Mueller-Mach et al. | |
| 6,513,949 | B1 | 2/2003 | Marshall et al. | |
| 6,566,232 | B1 * | 5/2003 | Hara | H01L 21/76898 257/E21.597 |
| 6,576,488 | B2 | 6/2003 | Collins, III et al. | |
| 6,603,258 | B1 | 8/2003 | Mueller-mach et al. | |
| 6,614,103 | B1 | 9/2003 | Durocher et al. | |
| 6,621,211 | B1 | 9/2003 | Srivastava et al. | |

(Continued)

FOREIGN PATENT DOCUMENTS

| | | |
|---|---|---|
| EP | 0265077 | 4/1988 |
| EP | 1067598 | 1/2001 |

(Continued)

OTHER PUBLICATIONS

PCT International Application No. PCT/US2014/050376, International Search Report and Written Opinion mailed on Dec. 8, 2014, 15 pages.

(Continued)

*Primary Examiner* — Anthony Ho
*Assistant Examiner* — Kevin Quinto
(74) *Attorney, Agent, or Firm* — Morgan, Lewis & Bockius LLP

(57) ABSTRACT

In accordance with certain embodiments, patches with replacement light-emitting elements thereon are utilized to repair lighting-system fault locations.

61 Claims, 16 Drawing Sheets

Related U.S. Application Data

(60) Provisional application No. 61/292,137, filed on Jan. 4, 2010, provisional application No. 61/315,903, filed on Mar. 19, 2010, provisional application No. 61/363,179, filed on Jul. 9, 2010, provisional application No. 61/376,707, filed on Aug. 25, 2010, provisional application No. 61/390,128, filed on Oct. 5, 2010, provisional application No. 61/393,027, filed on Oct. 14, 2010, provisional application No. 61/359,467, filed on Jun. 29, 2010, provisional application No. 61/443,249, filed on Jan. 16, 2011, provisional application No. 61/445,416, filed on Feb. 22, 2011, provisional application No. 61/447,680, filed on Feb. 28, 2011.

(56) References Cited

U.S. PATENT DOCUMENTS 6,642,652 B2 11/2003 Collins, III et al.
6,650,044 B1 11/2003 Lowery
6,685,852 B2 2/2004 Setlur et al.
6,733,711 B2 5/2004 Durocher et al.
6,936,857 B2 8/2005 Doxsee et al.
6,939,481 B2 9/2005 Srivastava et al.
6,965,361 B1 11/2005 Sheats et al.
6,998,777 B2 2/2006 Suehiro et al.
7,005,679 B2 2/2006 Tarsa et al.
7,025,651 B2 4/2006 Song et al.
7,052,924 B2 5/2006 Daniels et al.
7,115,983 B2 10/2006 Wagner
7,122,405 B2 10/2006 Tiao
7,163,327 B2 1/2007 Henson et al.
7,206,507 B2 4/2007 Lee et al.
7,207,693 B2 4/2007 Ratcliffe
7,217,956 B2 5/2007 Daniels et al.
7,244,326 B2 7/2007 Craig et al.
7,256,483 B2 8/2007 Epler et al.
7,259,030 B2 8/2007 Daniels et al.
7,294,861 B2 11/2007 Schardt et al.
7,294,961 B2 11/2007 Daniels et al.
7,316,488 B2 1/2008 Wall, Jr.
7,319,246 B2 1/2008 Soules et al.
7,335,951 B2 2/2008 Nishi et al.
7,344,902 B2 3/2008 Basin et al.
7,344,952 B2 3/2008 Chandra
7,427,782 B2 9/2008 Daniels et al.
7,488,088 B2 2/2009 Brukilacchio
7,488,621 B2 2/2009 Epler et al.
7,498,734 B2 3/2009 Suehiro et al.
7,564,070 B2 7/2009 Sayers et al.
7,618,157 B1 11/2009 Galvez et al.
7,638,854 B2 12/2009 Tanaka et al.
7,642,708 B2 1/2010 Juestel et al.
7,656,371 B2 2/2010 Shimizu et al.
7,663,234 B2 2/2010 Sun et al.
7,682,850 B2 3/2010 Harbers et al.
7,703,942 B2 4/2010 Narendran et al.
7,723,733 B2 5/2010 Daniels et al.
7,740,373 B2 6/2010 Yoon et al.
7,758,221 B2 7/2010 Weijers
7,766,536 B2 8/2010 Peifer et al.
7,775,685 B2 8/2010 Loh
7,791,093 B2 9/2010 Basin et al.
7,811,843 B1 10/2010 Lai
7,819,539 B2 10/2010 Kim et al.
7,821,023 B2 10/2010 Yuan et al.
7,828,459 B2 11/2010 Rains
7,838,346 B2 11/2010 Tokunaga
7,847,302 B2 12/2010 Basin et al.
7,855,092 B2 12/2010 Shimizu et al.
7,858,198 B2 12/2010 Kashiwagi et al.
7,858,408 B2 12/2010 Mueller et al.
1,000,214 A1 1/2011 Tsukahara et al.
7,863,760 B2 1/2011 Daniels et al.
7,897,483 B2 3/2011 Yamazaki et al.
7,898,085 B2 3/2011 Fujimori et al.
7,902,550 B2 3/2011 Yamazaki
7,902,560 B2 3/2011 Bierhuizen et al.
7,909,480 B2 3/2011 Kang et al.
7,909,496 B2 3/2011 Matheson et al.
7,932,531 B2 4/2011 Lin et al.
1,010,139 A1 5/2011 Suehiro et al.
1,010,483 A1 5/2011 Suehiro et al.
1,011,498 A1 5/2011 Suehiro et al.
1,016,368 A1 7/2011 Dau et al.
7,972,031 B2 7/2011 Ray et al.
7,997,784 B2 8/2011 Tsai
8,101,432 B2 1/2012 Oohata et al.
2003/0011377 A1* 1/2003 Oohata ..... G09G 3/006 324/512
2003/0019735 A1 1/2003 Howie et al.
2004/0047151 A1* 3/2004 Bogner ..... H01L 25/13 362/236
2004/0110326 A1* 6/2004 Forbes ..... G02F 1/1334 438/149
2005/0056948 A1 3/2005 Uchiyama
2005/0183884 A1 8/2005 Su
2005/0230853 A1 10/2005 Yoshikawa
2006/0001055 A1 1/2006 Ueno et al.
2006/0082315 A1* 4/2006 Chan ..... F21K 9/00 315/46
2006/0228973 A1 10/2006 Janning
2007/0018315 A1* 1/2007 Craig ..... C08G 59/3209 257/734
2007/0069663 A1 3/2007 Burdalski et al.
2007/0096113 A1 5/2007 Inoshita et al.
2007/0096272 A1 5/2007 Wang
2007/0145884 A1 6/2007 Wu et al.
2007/0252512 A1 11/2007 Bertram et al.
2007/0297020 A1 12/2007 Shen et al.
2008/0019134 A1 1/2008 Mukai
2008/0179602 A1 7/2008 Negley et al.
2008/0179611 A1 7/2008 Chitnis et al.
2008/0191231 A1* 8/2008 Park ..... H01L 25/0753 257/98
2008/0216699 A1* 9/2008 McAleer ..... F42B 12/36 102/367
2008/0315228 A1 12/2008 Krames et al.
2009/0002810 A1 1/2009 Jeon et al.
2009/0026915 A1 1/2009 Nagatomi et al.
2009/0073350 A1 3/2009 Toyama et al.
2009/0095966 A1 4/2009 Keller et al.
2009/0096370 A1 4/2009 Murazaki et al.
2009/0109668 A1 4/2009 Isobe
2009/0178834 A1 7/2009 Akutsu et al.
2009/0212257 A1 8/2009 Sohn et al.
2009/0239086 A1 9/2009 Ishizuka et al.
2009/0243457 A1 10/2009 Jung et al.
2009/0244882 A1 10/2009 Samber et al.
2009/0256163 A1 10/2009 Chakraborty
2010/0001631 A1 1/2010 Gotoh et al.
2010/0051984 A1 3/2010 West
2010/0060144 A1 3/2010 Justel et al.
2010/0085727 A1 4/2010 Igarashi et al.
2010/0096977 A1 4/2010 Lee et al.
2010/0155750 A1* 6/2010 Donofrio ..... H01L 33/005 257/91
2010/0207536 A1 8/2010 Burdalski et al.
2010/0214777 A1 8/2010 Suehiro et al.
2010/0244071 A1 9/2010 Wada et al.
2010/0277084 A1 11/2010 Lee et al.
2010/0283072 A1 11/2010 Kazlas et al.
2010/0295070 A1 11/2010 Su et al.
2010/0295077 A1 11/2010 Melman
2010/0295078 A1 11/2010 Chen et al.
2010/0320928 A1 12/2010 Kaihotsu et al.
2011/0031516 A1 2/2011 Basin et al.
2011/0045619 A1 2/2011 Ling
2011/0049545 A1* 3/2011 Basin ..... H01L 33/56 257/98
2011/0058372 A1 3/2011 Lerman et al.
2011/0063838 A1 3/2011 Dau et al.
2011/0108878 A1 5/2011 Namiki et al.
2011/0180818 A1 7/2011 Lerman et al.
2011/0193105 A1 8/2011 Lerman et al.

(56) References Cited

U.S. PATENT DOCUMENTS

| | | | |
|---|---|---|---|
| 2011/0193106 | A1 | 8/2011 | Lerman et al. |
| 2011/0193114 | A1 | 8/2011 | Lerman et al. |
| 2011/0195532 | A1 | 8/2011 | Lerman et al. |
| 2011/0198631 | A1 | 8/2011 | Lerman et al. |
| 2011/0198632 | A1 | 8/2011 | Lerman et al. |
| 2011/0204390 | A1 | 8/2011 | Lerman et al. |
| 2011/0204391 | A1 | 8/2011 | Lerman et al. |

FOREIGN PATENT DOCUMENTS

| | | | |
|---|---|---|---|
| EP | 1473978 | | 11/2004 |
| EP | 1653523 | | 5/2006 |
| EP | 1770788 | | 4/2007 |
| EP | 2017890 | | 1/2009 |
| JP | 10-84014 | A | 3/1998 |
| JP | 2000-124401 | A | 4/2000 |
| JP | 2002-366054 | A | 12/2002 |
| TW | 423166 | | 9/1999 |
| WO | WO-90/01751 | | 2/1990 |
| WO | WO-99/60829 | | 11/1999 |
| WO | WO-2005/062382 | | 7/2005 |
| WO | WO-2007/067758 | | 6/2007 |
| WO | WO-2007/105853 | | 9/2007 |
| WO | WO-2008/051397 | | 5/2008 |
| WO | WO-2009/079040 | | 6/2009 |
| WO | WO-2010/098273 | | 9/2010 |
| WO | 2015/023540 | A1 | 2/2015 |

OTHER PUBLICATIONS

International Search Report and Written Opinion mailed Jun. 2, 2011 for International Application No. PCT/CA2011/050006 (7 pages).

International Search Report and Written Opinion mailed Sep. 7, 2011 for International Application No. PCT/CA2011/050399 (11 pages).

* cited by examiner

LIGHT-EMITTING ELEMENT REPAIR IN ARRAY-BASED LIGHTING DEVICES

RELATED APPLICATIONS

This application is a continuation-in-part of U.S. patent application Ser. No. 13/183,684, filed Jul. 15, 2011, which (i) is a continuation-in-part of U.S. patent application Ser. No. 12/982,758, filed Dec. 30, 2010, which claims the benefit of and priority to U.S. Provisional Patent Application No. 61/292,137, filed Jan. 4, 2010, U.S. Provisional Patent Application No. 61/315,903, filed Mar. 19, 2010, U.S. Provisional Patent Application No. 61/363,179, filed Jul. 9, 2010, U.S. Provisional Patent Application No. 61/376,707, filed Aug. 25, 2010, U.S. Provisional Patent Application No. 61/390,128, filed Oct. 5, 2010, and U.S. Provisional Patent Application No. 61/393,027, filed Oct. 14, 2010, and (ii) is a continuation-in-part of U.S. patent application Ser. No. 13/171,973, filed Jun. 29, 2011, which claims the benefit of and priority to U.S. Provisional Patent Application No. 61/359,467, filed Jun. 29, 2010, U.S. Provisional Patent Application No. 61/363,179, filed Jul. 9, 2010, U.S. Provisional Patent Application No. 61/376,707, filed Aug. 25, 2010, U.S. Provisional Patent Application No. 61/390,128, filed Oct. 5, 2010, U.S. Provisional Patent Application No. 61/393,027, filed Oct. 14, 2010, U.S. Provisional Patent Application No. 61/433,249, filed Jan. 16, 2011, U.S. Provisional Patent Application No. 61/445,416, filed Feb. 22, 2011, and U.S. Provisional Patent Application No. 61/447,680, filed Feb. 28, 2011. The entire disclosure of each of these applications is hereby incorporated herein by reference.

FIELD OF THE INVENTION

The present invention generally relates to light-emitting systems, and more specifically to the repair and/or replacement of defective light-emitting elements in light-emitting systems incorporating arrays of light-emitting elements.

BACKGROUND

Solid-state light sources such as light-emitting diodes (LEDs) are an attractive alternative to incandescent light bulbs in illumination devices due to their higher efficiency, smaller form factor, longer lifetime, and enhanced mechanical robustness. LEDs may be grouped in clusters or arrays to provide a desired light output characteristics corresponding to design requirements and/or application specifications.

However, lighting devices featuring arrays of interconnected LEDs may suffer from issues that plague all interconnected networks of devices—when a single device fails, the failure may degrade the performance of other devices, or even shut one or more (or even all) of them off entirely. One or more LEDs may fail during manufacture or operation due to a fault in, e.g., the LED itself fails, or a failure may occur in one or more of the conductive traces supplying power to the LED, in the substrate to which the LED is attached, or in an electrical or mechanical connection between the LED contacts and the traces. Such faults may result in an intermittent connection or an open or short circuit. In some cases, the failure of even a single LED may be unacceptable from a visual appearance and/or performance perspective, such as degradation in the illumination intensity, efficiency and/or uniformity.

Accordingly, there is a need for structures, systems and procedures enabling inexpensive and efficient repair methods for array-based illumination systems.

SUMMARY

In accordance with certain embodiments, an illumination device incorporates, electrically connected to a power source, multiple light-emitting strings, i.e., paths for the provision of power (i.e., current and/or voltage) from the power source to groups of light-emitting elements (LEEs) such as LEDs. Each string includes a power conductor, such as an electrical trace (or a series thereof), on which multiple LEEs are connected in, e.g., series. Each LEE bridges a gap in the power conductor between a pair of contacts. One or more inoperative LEEs are identified in the illumination device. As used herein, an "inoperative" LEE is an LEE responding to applied power (e.g., voltage) with only intermittent light output, as a short-circuit failure, or as an open-circuit failure (i.e., not emitting light). The inoperative LEE may be physically removed from the device (along with, in some embodiments, portions of the substrate below the LEE and/or one or more of the electrical traces), or the device may be repaired with the inoperative LEE in place. If left in place, the inoperative LEE may be electrically isolated from the other LEEs in the device via, e.g., removal of a portion of one or more of the electrical traces coupled to the inoperative LEE. The failure point defined by the inoperative LEE or the gap where the inoperative LEE was removed is repaired via application of a patch over or under the device substrate at the failure point. The patch contains one or more replacement LEEs coupled to conductive traces that are coupled to the electrical traces of the device when the patch is applied.

As utilized herein, the term "light-emitting element" (LEE) refers to any device that emits electromagnetic radiation within a wavelength regime of interest, for example, visible, infrared or ultraviolet regime, when activated, by applying a potential difference across the device or passing a current through the device. Examples of LEEs include solid-state, organic, polymer, phosphor-coated or high-flux LEDs, microLEDs (described below), laser diodes or other similar devices as would be readily understood. The emitted radiation of an LEE may be visible, such as red, blue or green, or invisible, such as infrared or ultraviolet. An LEE may produce radiation of a spread of wavelengths. An LEE may feature a phosphorescent or fluorescent material for converting a portion of its emissions from one set of wavelengths to another. An LEE may include multiple LEEs, each emitting essentially the same or different wavelengths. In some embodiments, an LEE is an LED that may feature a reflector over all or a portion of its surface upon which electrical contacts are positioned. The reflector may also be formed over all or a portion of the contacts themselves. In some embodiments, the contacts are themselves reflective.

An LEE may be of any size. In some embodiments, a LEE has one lateral dimension less than 500 μm, while in other embodiments a LEE has one lateral dimension greater than 500 um. Exemplary sizes of a relatively small LEE may include about 175 μm by about 250 μm, about 250 μm by about 400 μm, about 250 μm by about 300 μm, or about 225 μm by about 175 μm. Exemplary sizes of a relatively large LEE may include about 1000 μm by about 1000 μm, about 500 μm by about 500 μm, about 250 μm by about 600 μm, or about 2000 μm by about 2000 μm. In some embodiments, a LEE includes or consists essentially of a small LED die, also referred to as a "microLED." A microLED generally has one lateral dimension less than about 300 μm. In some embodiments, the LEE has one lateral dimension less than about 200 μm or even less than about 100 μm. For example, a microLED may have a size of about 225 μm by about 175 μm or about 150 μm by about 100 μm or about 150 μm by about 50 μm. In some embodiments, the surface area of the top surface of a microLED is less than 50,000 $\mu m^2$ or less than 10,000 $\mu m^2$. The size of the LEE is not a limitation of the present invention, and in other embodiments the LEE may be relatively larger, e.g., the LEE may have one lateral dimension on the order of at least about 1000 μm or at least about 3000 μm.

As used herein, "phosphor" or "light-conversion material" refers to any material that shifts the wavelengths of light irradiating it and/or that is fluorescent and/or phosphorescent, and is utilized interchangeably with the term "wavelength-conversion material" or "phosphor-conversion element." As used herein, a "phosphor" may refer to only the powder or particles (of one or more different types) or to the powder or particles with the binder. The light-conversion material is incorporated to shift one or more wavelengths of at least a portion of the light emitted by LEEs to other desired wavelengths (which are then emitted from the larger device alone or color-mixed with another portion of the original light emitted by the die). A light-conversion material may include or consist essentially of phosphor powders, quantum dots, organic dye or the like within a transparent matrix. Phosphors are typically available in the form of powders or particles, and in such case may be mixed in binders. An exemplary binder is silicone, i.e., polyorganosiloxane, which is most commonly polydimethylsiloxane (PDMS). Phosphors vary in composition, and may include lutetium aluminum garnet (LuAG or GAL), yttrium aluminum garnet (YAG) or other phosphors known in the art. GAL, LuAG, YAG and other materials may be doped with various materials including for example Ce, Eu, etc. The specific components and/or formulation of the phosphor and/or matrix material are not limitations of the present invention.

The binder may also be referred to as an encapsulant or a matrix material. In one embodiment, the binder includes or consists essentially of a transparent material, for example silicone-based materials or epoxy, having an index of refraction greater than 1.35. In one embodiment the phosphor includes or consists essentially of other materials, for example fumed silica or alumina, to achieve other properties, for example to scatter light, or to reduce settling of the powder in the binder. An example of the binder material includes materials from the ASP series of silicone phenyls manufactured by Shin Etsu, or the Sylgard series manufactured by Dow Corning.

In some embodiments, various elements such as substrates, tapes, or patches are "flexible" in the sense of being pliant in response to a force and resilient, i.e., tending to elastically resume an original configuration upon removal of the force. Such elements may have a radius of curvature of about 20 cm or less, or about 5 cm or less, or even about 1 cm or less. In some embodiments, flexible elements have a Young's Modulus less than about $50\times10^9$ $N/m^2$, less than about $10\times10^9$ $N/m^2$, or even less than about $5\times10^9$ $N/m^2$. In some embodiments, flexible elements have a Shore A hardness value less than about 100; a Shore D hardness less than about 100; and/or a Rockwell hardness less than about 150.

Herein, two components such as light-emitting elements, optical elements, and/or phosphor chips being "aligned" or "associated" with each other may refer to such components being mechanically and/or optically aligned. By "mechanically aligned" is meant coaxial or situated along a parallel axis. By "optically aligned" is meant that at least some light (or other electromagnetic signal) emitted by or passing through one component passes through and/or is emitted by the other.

In an aspect, embodiments of the invention feature a lighting system including or consisting essentially of a substrate, a plurality of spaced-apart conductive traces defining a plurality of gaps therebetween and disposed on the substrate, a plurality of light-emitting elements disposed over the substrate, a fault location, and a patch disposed over or under the substrate at the fault location. Each light-emitting element is disposed within a gap and electrically connected to the conductive traces defining the gap. The fault location is defined by a gap between two conductive traces either (i) lacking a light-emitting element therein or (ii) comprising an inoperative light-emitting element therein. The patch includes or consists essentially of (i) a patch substrate, (ii) two conductive traces disposed on the patch substrate, and (iii) a replacement light-emitting element electrically coupled to the two conductive traces of the patch. The conductive traces of the patch are each electrically connected to one of the conductive traces defining the fault location, thereby electrically connecting the replacement light-emitting element across the fault location.

Embodiments of the invention may include one or more of the following in any of a variety of different combinations. The replacement light-emitting element may include or consist essentially of a bare-die light-emitting diode or a packaged light-emitting diode. The fault location may include an inoperative light-emitting element therein. The inoperative light-emitting element may be electrically isolated from at least one of the conductive traces at the fault location. The patch substrate may define a recess. At least a portion of the inoperative light-emitting element may be disposed in the recess. The fault location may lack a light-emitting element therein. The substrate may define a hole therethrough in the fault location. The replacement light-emitting element may include two spaced-apart contacts each electrically coupled to one of the conductive traces on the patch substrate via a conductive adhesive, an anisotropic conductive adhesive, and/or an anisotropic conductive film. The conductive traces on the patch substrate may be each electrically coupled to one of the conductive traces defining the failure point via a conductive adhesive, an anisotropic conductive adhesive, an anisotropic conductive film, a conductive tape, and/or a solid conductive fastener. The substrate and/or the patch substrate may include at least one alignment feature for facilitating alignment of the patch to the failure point. The alignment feature may include or consist essentially of an alignment mark, a recess, a hole, a blind hole, and/or a protrusion.

The two conductive traces of the patch may be disposed on a first surface of the patch substrate. The patch substrate may include an additional two conductive traces on a second surface of the patch substrate opposite the first surface. The two conductive traces of the patch may be electrically coupled to the conductive traces defining the failure point via the two additional conductive traces on the second surface of the patch substrate. The two additional conductive traces on the second surface of the patch substrate may be each electrically coupled to one of the conductive traces defining the failure point via a conductive adhesive, a conductive tape, an anisotropic conductive adhesive, and/or a anisotropic conductive film. The replacement light-emitting element may be disposed between the patch substrate and the substrate. The patch substrate may be disposed between the replacement light-emitting element and the substrate. The substrate may have first and second opposing surfaces, the light-emitting elements and conductive traces may be disposed over the first surface of the substrate, and the patch may be disposed over the first surface of the substrate. The substrate may have first and second opposing surfaces, the light-emitting elements and conductive traces may be disposed over the first surface of the substrate, and the patch may be disposed over the second surface of the substrate.

The patch substrate may include or consist essentially of polyethylene naphthalate, polyethylene terephthalate, polycarbonate, polyethersulfone, polyester, polyimide, polyethylene, fiberglass, metal-core printed circuit board, metal foil, silicon, and/or paper. The conductive traces on the substrate (and/or on the patch substrate) may include or consist essentially of gold, silver, copper, aluminum, chromium, carbon, silver ink, and/or copper ink. The light-emitting elements may emit substantially white light. The conductive traces on the patch substrate may be disposed on a first surface of the patch substrate, and only portions of the patch substrate may be folded such that the conductive traces are electrically coupled to the conductive traces defining the failure point therebelow. The lighting system may include a reflective layer (i) reflective to a wavelength of light emitted by the replacement light-emitting element, and (ii) positioned to reflect light emitted by the replacement light-emitting element in a direction of light emitted by the light-emitting elements on the substrate.

In another aspect, embodiments of the invention feature a method for repairing a lighting system including or consisting essentially of (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap. A fault location defined by a gap between two conductive traces either (i) lacking a light-emitting element therein or (ii) comprising an inoperative light-emitting element therein is identified. A patch is disposed over or under the substrate at the fault location. The patch includes or consists essentially of (i) a patch substrate, (ii) two conductive traces disposed on the patch substrate, and (iii) a replacement light-emitting element electrically coupled to the two conductive traces of the patch. The replacement light-emitting element is electrically connected across the fault location by electrically connecting each of the conductive traces of the patch to one of the conductive traces defining the fault location.

Embodiments of the invention may include one or more of the following in any of a variety of different combinations. Identifying the fault location may include or consist essentially of applying power to at least some of the light-emitting elements. The conductive traces and light-emitting elements on the substrate may be organized in a plurality of light-emitting strings. Each light-emitting string may (i) comprise a plurality of series-connected light-emitting elements spanning gaps between conductive traces, (ii) have a first end electrically coupled to a first power conductor, and (ii) have a second end electrically coupled to a second power conductor different from the first power conductor. Identifying the fault location may include or consist essentially of applying power to each light-emitting element in each light-emitting string. Power may be applied twice to one or more, but not all, light-emitting elements in each light-emitting string. Identifying the fault location may include or consist essentially of electrically contacting (i) the first power conductor and (ii) a conductive trace on the substrate within a light-emitting string but not physically connected to the first or second power connectors. Identifying the fault location may include or consist essentially of measuring an optical characteristic of a light-emitting element disposed at the fault location. The optical characteristic may include or consist essentially of light output power, wavelength, color temperature, color rendering index, efficiency, and/or luminous efficacy. Identifying the fault location may include or consist essentially of measuring an electrical characteristic of a light-emitting element disposed at the fault location. The electrical characteristic may include or consist essentially of forward voltage and/or reverse leakage voltage.

Each of the conductive traces of the patch may be electrically connected to one of the conductive traces defining the fault location via a conductive adhesive, a conductive tape, an anisotropic conductive adhesive, an anisotropic conductive film, and/or a solid conductive fastener. An inoperative light-emitting element may be disposed at the fault location, and, after identifying the fault location, the inoperative light-emitting element may be electrically isolated from at least one of the conductive traces at the fault location. Electrically isolating the inoperative light-emitting element may include or consist essentially of removing the inoperative light-emitting element from the lighting system. A portion of the substrate at the fault location and/or portions of the conductive traces at the fault location may be removed. Electrically isolating the inoperative light-emitting element may include or consist essentially of removing a portion of the at least one conductive trace proximate the fault location. Identifying the fault location, disposing the patch, and electrically connecting the replacement light-emitting element may be performed in a roll-to-roll process.

In yet another aspect, embodiments of the invention feature a patch for repairing a fault location on a lighting system. The lighting system includes or consists essentially of (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap. The fault location is defined by a gap between two conductive traces either (i) lacking a light-emitting element therein or (ii) comprising an inoperative light-emitting element therein. The patch includes or consists essentially of a patch substrate, two conductive traces disposed on the patch substrate, and a replacement light-emitting element electrically coupled to the two conductive traces of the patch. The conductive traces of the patch are each electrically connectable to one of the conductive traces of the lighting system defining the fault location to thereby electrically connect the replacement light-emitting element across the fault location. The patch substrate may be sized and shaped to be disposed over or under the fault location without overlying or underlying a light-emitting element of the lighting system not disposed at the fault location.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. The term "light" broadly connotes any wavelength or wavelength band in the electromagnetic spectrum, including, without limitation, visible light, ultraviolet radiation, and infrared radiation. Similarly, photometric terms such as "illuminance," "luminous flux," and "luminous intensity" extend to and include their radiometric equivalents, such as "irradiance," "radiant flux," and "radiant intensity." As used herein, the terms "substantially," "approximately," and "about" mean±10%, and in some embodiments, ±5%. The term "consists essentially of" means excluding other materials that contribute to function, unless otherwise defined herein. Nonetheless, such other materials may be present, collectively or individually, in trace amounts.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
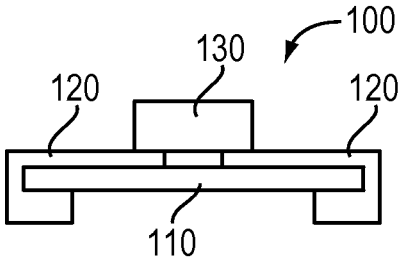
FIG. 1A is a schematic cross-section of a patch for illumination-system repair in accordance with various embodiments of the invention.
Figure 1B:
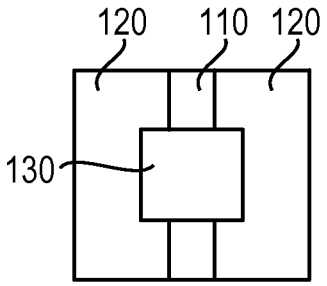
FIG. 1B is a schematic plan view of the patch of FIG. 1A.

FIGS. 1A and 1B depict an exemplary illumination repair system 100 in accordance with embodiments of the present invention, although alternative systems with similar functionality are also within the scope of the invention. As seen in the cross-sectional view of FIG. 1A and the plan view of FIG. 1B, the repair system 100, also referred to as a "patch," includes or consists essentially of a substrate 110, at least one LEE 130, and conductive traces 120. Conductive traces 120 may also be referred to herein as "conductive elements." In use, patch 100 is mechanically attached and electrically coupled to an illumination system, for example to replace or substitute for a failed LEE. For clarity purposes, the contacts on LEE 130 are not shown, nor is the method of electrical coupling of LEE 130 to conductive traces 120. These will be discussed in detail herein.

Figure 1C:
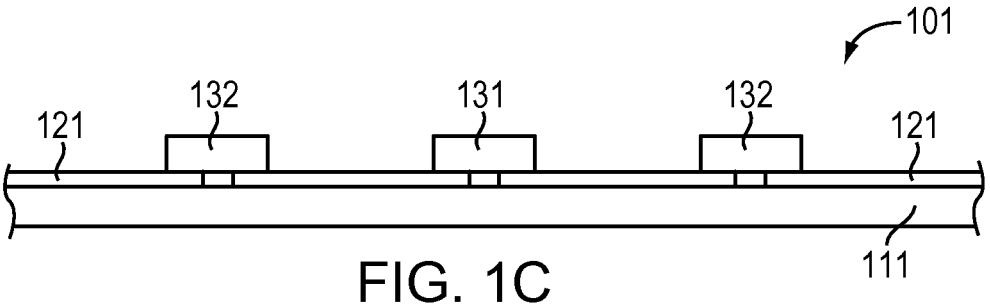
FIG. 1C is a schematic cross-section of an illumination system with a failed light-emitting element used in accordance with various embodiments of the invention.

FIG. 1C shows an example of an illumination system 101 including or consisting essentially of a substrate 111, conductive traces 121, operational LEEs 132, and a failed LEE 131. There are a number of different failure modes for LEE 131, including but not limited to, e.g., a short-circuit failure, an open-circuit failure, or an intermittent failure (i.e., the failed LEE may flicker or be non-operational periodically during operation of the illumination system). For example, in an intermittent failure, LEE 131 may operate properly at some times and at other times operate improperly, for example emitting light at some times, but not others, or exhibiting a leakage current or forward voltage (or other parameters) that are not within specification. In some embodiments, failed LEE 131 may be a result of a failure within LEE 131 itself, for example a short of the semiconductor p-n junction in the embodiment where LEE 131 includes or consists essentially of an LED, while in other embodiments, the failure may be a result of a failure of the contacts to the LEE or of an intermittent, short or open electrical connection, or a mechanical failure causing an electrical failure, for example in the electrical coupling method, the conductive traces, or the like. The failure mode is not a limitation of the present invention. The electrical coupling and mechanical attachment of LEE 131 and LEEs 132 in illumination system 101 may be accomplished by a variety of means, including wire bonding, solder, conductive adhesive, anisotropic conductive adhesive or the like; the method of coupling and mechanically attaching LEE 131 and LEEs 132 in illumination system 101 is not a limitation of the present invention.

Figure 1D:
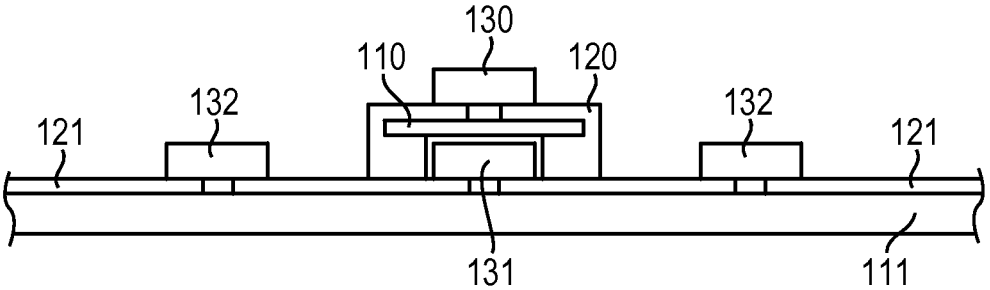
FIG. 1D is a schematic cross-section of the patch of FIG. 1A utilized to repair the illumination system of FIG. 1C in accordance with embodiments of the invention.
Figure 1E:
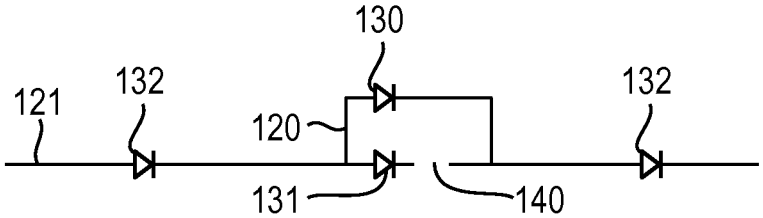
FIG. 1E is a circuit diagram corresponding to the repaired illumination system of FIG. 1D in accordance with embodiments of the invention.

FIG. 1D shows an example of patch 100 applied to illumination system 101 to replace the failed LEE 131. As may be seen with reference to FIG. 1D, patch 100 is disposed over the failed LEE 131 such that conductive traces 120 electrically bridge LEE 131 and that LEE 130 is electrically coupled in parallel with the failed LEE 131. An electrical schematic corresponding to the schematic in FIG. 1D is shown in FIG. 1E. As shown, where the failure mode for LEE 131 is an open circuit, identified schematically as an open failure 140 in FIG. 1E, LEE 130 takes the place of failed LEE 131, resulting in a fully operational illumination system, preferably with substantially no change in electrical or optical properties. In this example, the LEE 130 on patch 100 and LEEs 132 on illumination system 101 are substantially the same (i.e., in terms of properties such as forward voltage and light-output level as a function of current); however, this is not a limitation of the present invention, and in other embodiments LEE 130 may be different from LEEs 132. Specific methods and structures for electrically and mechanically coupling patch 100 to illumination system 101 are discussed herein.

Figure 1F:
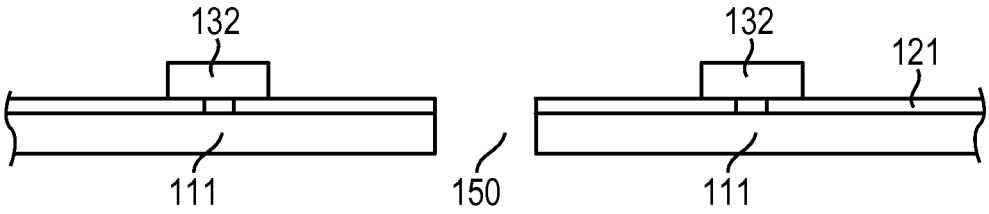
FIG. 1F is a schematic cross-section of an illumination system after removal of a failed light-emitting element in accordance with embodiments of the invention.
Figure 1G:
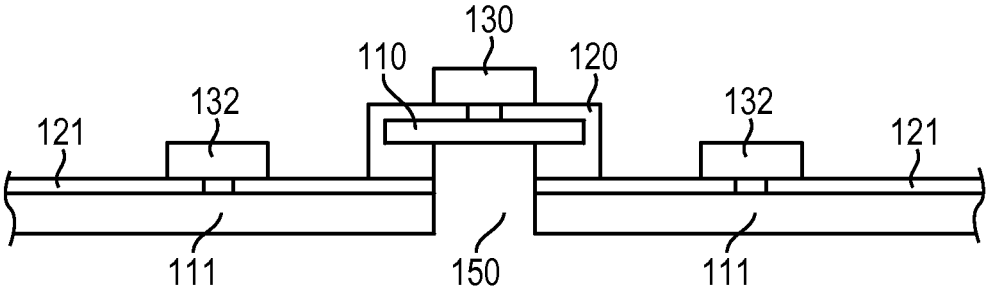
FIG. 1G is a schematic cross-section of the illumination system of FIG. 1F after addition of a repair patch to replace the failed light-emitting element in accordance with embodiments of the invention.
Figure 1H:
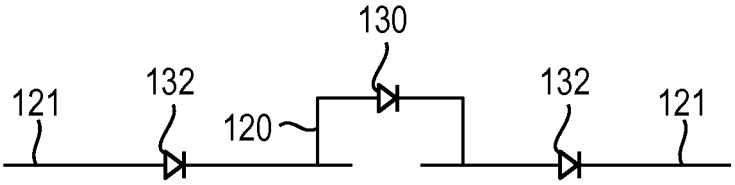
FIG. 1H is a circuit diagram corresponding to the repaired illumination system of FIG. 1G in accordance with embodiments of the invention.

In the case of a short circuit or intermittent failure, or other failure modes, it may be necessary to remove failed LEE 131 before or after patch 100 is applied. FIG. 1F shows an example of the illumination system 101 of FIG. 1C after removal of failed LEE 131. In this example, the failed LEE 131 has been removed by removing a portion of substrate 111 and a portion of conductive traces 121 under and adjacent to failed LEE 131, leaving a hole, gap, void, or opening 150; however, this is not a limitation of the present invention, and in other embodiments LEE 131 may be removed in other ways, for example removal of failed LEE 131 while leaving substrate 111 and conductive traces 121 substantially intact, as will be described herein. FIG. 1G shows patch 100 applied to the structure of FIG. 1F such that LEE 130 is electrically coupled in parallel with the open circuit (i.e., gap 150) left by the removal of failed LEE 131. FIG. 1H shows an electrical schematic of the structure of FIG. 1G in which LEE 130 replaces the removed failed LEE 131. In this example, the failed LEE 131 is removed before application of patch 100; however, in other embodiments patch 100 may be applied before removal of failed LEE 131.

In some embodiments of the present invention, the LEEs include or consist essentially of bare semiconductor dies (i.e., a bare-die LEE is an unpackaged semiconductor die), while in other embodiments the LEEs include or consist essentially of packaged LEDs. In some embodiments, substitute LEE 130 may be different from operational LEE 132 and/or failed LEE 131. For example, failed LEE 131 may include or consist essentially of a bare semiconductor die, while LEE 130 includes or consists essentially of a packaged LED.

In many embodiments, the LEEs may include a wavelength-conversion material surrounding all or a portion of the LEE. In some embodiments, the LEE may be configured to emit white light (e.g., via mixture of light converted by the wavelength-conversion material and unconverted light emitted by the LEE). As will be understood by those skilled in the art, there are a number of ways of incorporating phosphor with an LEE, and the method of phosphor incorporation is not a limitation of the present invention.

Substrates 110, 111 may each include or consist essentially of a semicrystalline or amorphous material, e.g., polyethylene naphthalate (PEN), polyethylene terephthalate (PET), polycarbonate, polyethersulfone, polyester, polyimide, polyethylene, fiberglass, FR4, metal core printed circuit board, (MCPCB), metal, metal foil, silicon, and/or paper. Substrates 110, 111 may include multiple layers, e.g., a deformable layer over a rigid layer, for example, a semicrystalline or amorphous material, e.g., PEN, PET, polycarbonate, polyethersulfone, polyester, polyimide, polyethylene, and/or paper formed over a rigid substrate for example comprising, acrylic, aluminum, steel, and the like. Depending upon the desired application for which embodiments of the invention are utilized, substrates 110, 111 may be substantially optically transparent, translucent, or opaque. For example, substrates 110, 111 may exhibit a transmittance or a reflectivity greater than 70% for optical wavelengths ranging between approximately 400 nm and approximately 700 nm. In some embodiments, substrates 110 and 111 may exhibit a transmittance or a reflectivity of greater than 70% for one or more wavelengths emitted by an LEE 130. Substrates 110, 111 may also be substantially insulating, and may have an electrical resistivity greater than approximately 100 ohm-cm, greater than approximately $1\times10^{6}$ ohm-cm, or even greater than approximately $1\times10^{10}$ ohm-cm. In some embodiments, substrate 110 may be the same as substrate 111, while in other embodiments substrate 110 may be different from substrate 111.

Conductive elements 120, 121 may be formed via conventional deposition, photolithography, and etching processes, plating processes, lamination, lamination and patterning, evaporation sputtering, or the like, or they may be formed using a variety of different printing processes. For example, conductive elements 120, 121 may be formed via screen printing, flexographic printing, ink-jet printing, and/or gravure printing. Conductive elements 120, 121 may include or consist essentially of a conductive material (e.g., an ink or a metal, metal film or other conductive materials or the like), which may include one or more elements such as silver, gold, aluminum, chromium, copper, and/or conductive carbon. Conductive elements 120, 121 may have a thickness in the range of about 50 nm to about 1000 μm, or more preferably in the range of about 1 μm to about 150 μm. In some embodiments, the thickness of conductive elements 120, 121 may be determined by the current to be carried thereby. While the thickness of one or more of conductive elements 120, 121 may vary, the thickness is generally substantially uniform along the length of the trace to simplify processing. However, this is not a limitation of the present invention, and in other embodiments the thickness and/or material of conductive elements 120, 121 may vary.

In some embodiments of the present invention, all or portions of conductive elements 120, 121 and/or substrates 110, 111 may be covered by a cover layer or cover material. In some embodiments, the cover layer may include or consist essentially of an insulating layer, for example to prevent electrical connectivity with conductive elements 120,121. In some embodiments, the insulating material may include or consist essentially of, e.g., one or more layers formed over the back or front surface of the substrate. Such layers may include or consist essentially of a material the same as or similar to that of substrate 110, 111, e.g., PET, PEN, polyimide, polyester, acrylic, or the like. In some embodiments, the insulating material may include or consist essentially of, for example, silicone, silicon oxide, silicon dioxide, silicon nitride, or the like. In some embodiments, the insulating material may include or consist essentially of an ink, where the ink may have one or a plurality of colors and/or may be arranged in one or more markings. For example, markings may include identification of the lightsheet type or part number, identification of power conductors, identification of specific lengths of the lightsheet, for example to mark portions of specific lengths, identification of cut regions where a lightsheet may be separated into portions, or the like. In some embodiments, the insulating material includes or consists essentially of a white ink. In some embodiments, the insulating material may be a separate layer adhered to the substrate, for example using glue or adhesive or tape. In some embodiments, the insulating material may be formed over the substrate by, for example, spray coating, dip coating, printing, sputtering, evaporation, chemical vapor deposition or the like. In some embodiments, the insulating layer may be patterned and a portion of the insulating layer removed to permit access to a portion of the underlying lightsheet (as utilized herein, "lightsheet" refers to a substrate with one or more LEEs thereon for light emission). In some embodiments, the insulating layer may be patterned such that it does not cover LEEs 130. In some embodiments, patterning may be achieved by selective deposition, for example, selective spray coating, or by patterning and etching or removal of portions of the insulating layer. In some embodiments, the cover layer may have additional properties, for example, to provide flame resistance or to provide a reflective or light-absorbing surface. In some embodiments, a front cover material is reflective to a wavelength of light emitted by LEEs 130. In some embodiments, the front cover material is white. In some embodiments, the back (i.e., on the surface opposite the surface on which the LEEs are disposed) cover layer is black.

LEEs 130, 131, and/or 132 may be electrically coupled and/or mechanically attached to conductive traces 120, 121 and/or substrate 110, 111 using a variety of means, for example conductive adhesive, non-conductive adhesive, a combination of conductive and non-conductive adhesives, anisotropic conductive adhesive (ACA), solder, wire bonding, or the like. In preferred embodiments, the attachment methods include or consist essentially of at least one of conductive adhesive, non-conductive adhesive, a combination of conductive and non-conductive adhesives, ACA, or solder.

In one embodiment, conductive traces 120,121 are formed with a gap between adjacent conductive traces 120, 121, and LEEs 130, 131, and/or 132 are electrically coupled to conductive traces 120, 121 using, e.g., an isotropically conductive adhesive, an ACA, and/or solder. In one embodiment, conductive traces 120,121 are formed with a gap between adjacent conductive traces 120, 121, and LEEs 130, 131 and/or 132 are electrically coupled to conductive traces 120, 121 using ACA as described in U.S. patent application Ser. No. 13/171,973, filed Jun. 29, 2011, or U.S. patent application Ser. No. 13/799,807, filed Mar. 13, 2013, the entire disclosure of each of which is incorporated by reference herein.

Figure 2A:
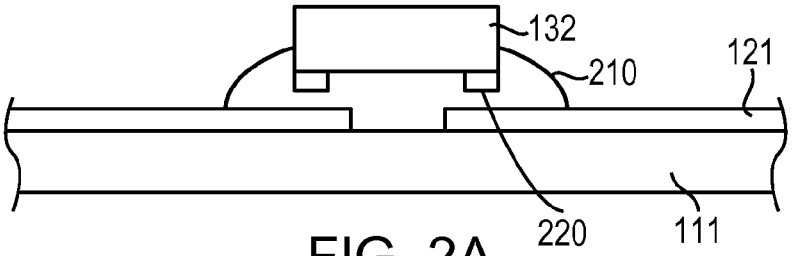
FIG. 2A is a schematic cross-section of a light-emitting element of an illumination system in accordance with embodiments of the invention.
Figure 2B:
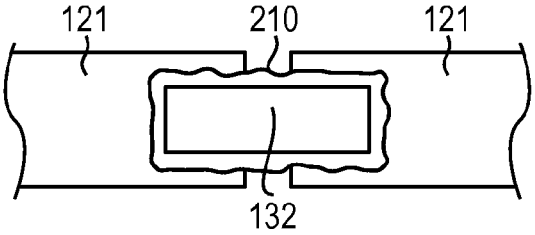
FIG. 2B is a schematic plan view of the light-emitting element of FIG. 2A.

FIGS. 2A and 2B are cross-sectional and plan-view depictions, respectively, of one example of an LEE 132 having contact pads 220 electrically coupled to conductive traces 121 using an ACA 210. ACAs may be utilized with or without stud bumps and embodiments of the present invention are not limited by the particular mode of operation of the ACA. For example, the ACA may be cured and/or activated using heat, pressure, a combination of heat and pressure, or other means. Furthermore, various embodiments utilize one or more other electrically conductive adhesives, e.g., isotropically conductive adhesives, non-conductive adhesives, in addition to or instead of one or more ACAs. While the structure shown in FIGS. 2A and 2B is described in reference to the lighting system, ACA may also be used to attach a replacement LEE 130 to conductive traces 120 on patch 100. In some embodiments, the same structure and attachment method may be used for the patch as for the lighting system to be repaired; however, this is not a limitation of the present invention, and in other embodiments different structures and different attachment methods may be utilized.

Patch 100 may be electrically and/or mechanically coupled to lighting system 101 using a variety of means, for example an adhesive, a conductive adhesive, a combination of conductive and non-conductive adhesives, electrically conductive tape, staples, rivets, conductive staples, conductive rivets, or the like. (As used herein, a "solid conductive fastener" may be a staple or rivet or other substantially non-flexible and solid means of attachment).

Figure 3A:
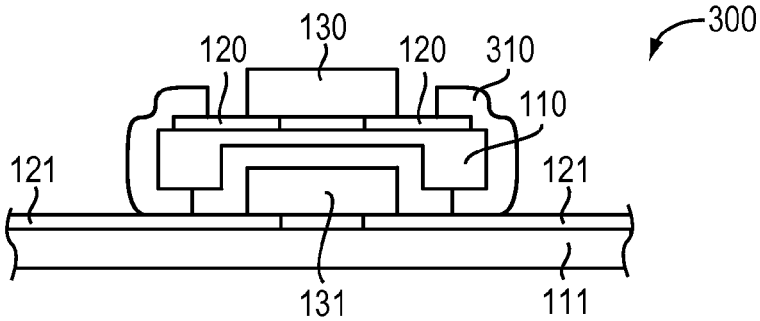
FIG. 3A is a schematic cross-section of a patch repairing a portion of an illumination system in accordance with embodiments of the invention.
Figure 3B:
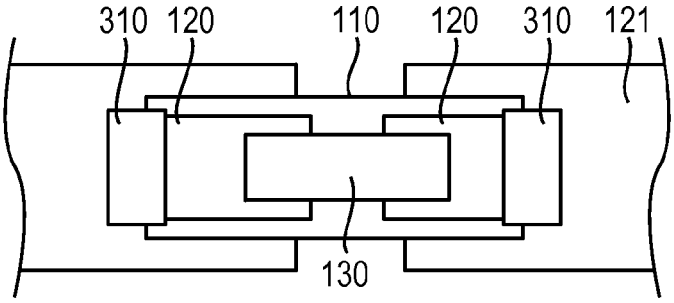
FIG. 3B is a schematic plan view of the patch of FIG. 3A.
Figure 3C:
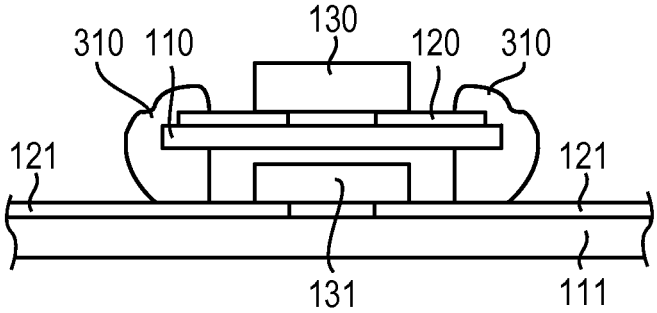
FIG. 3C is a schematic cross-section of a patch having a planar substrate repairing a portion of an illumination system in accordance with embodiments of the invention.

In one embodiment, a patch is electrically and mechanically coupled to lighting system 101 using an electrically conductive flexible tape. FIGS. 3A and 3B are cross-sectional and plan-view depictions, respectively, of an example of a patch 300 applied using an electrically conductive tape 310. In this example, conductive traces 120 on patch substrate 110 are formed only on one side of patch substrate 110—the same side as LEE 130. Conductive tape 310 is applied to conductive traces 120 and wrapped around the edge of substrate 110 to cover a portion of the back of substrate 110 to permit electrical connection and mechanical adhesion to underlying conductive traces 121. This embodiment permits the manufacture of patch 300 with conductive traces 120 only on the front, or top side, of patch 300. In this embodiment, conductive tape 310 is conductive both laterally and through its thickness and is adhesive on both sides. In some embodiments, a portion of conductive tape 310 also adheres patch 300 to underlying substrate 111 (in addition to the adhesion to the traces 121). As shown, LEE 130 on patch 300 replaces failed LEE 131. In this embodiment, failed LEE 131 has not been removed, but this is not a limitation of the present invention, and in other embodiments failed LEE 131 may be removed before or after application of patch 300. FIG. 3C shows an example in which patch substrate 110 is substantially planar, in contrast to the patch substrate 110 shown in FIGS. 3A and 3B that has one or more protruding portions.

Figure 4A:
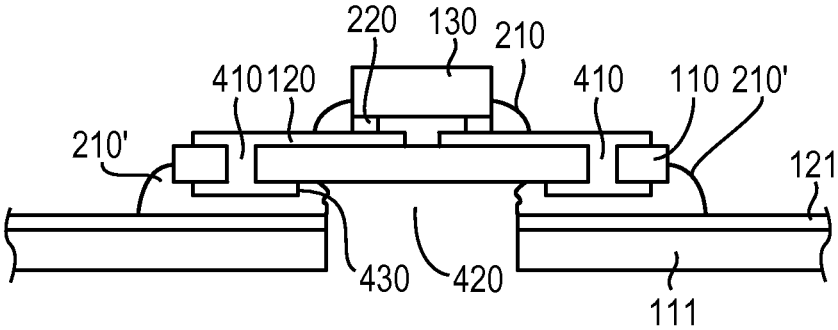
FIG. 4A is a schematic cross-section of a patch repairing a portion of an illumination system above a gap in the illumination system in accordance with embodiments of the invention.
Figure 4B:
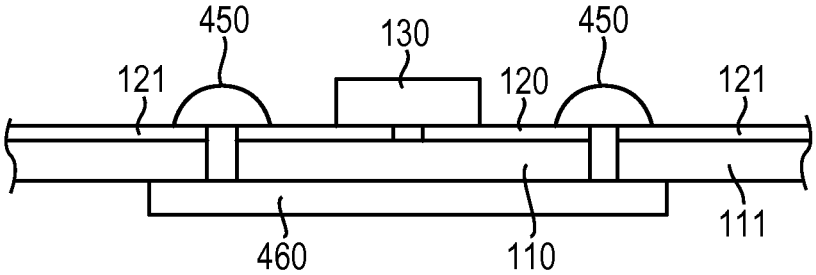
FIG. 4B is a schematic cross-section of a patch repairing a portion of an illumination system at least partially within a gap in the illumination system in accordance with embodiments of the invention.
Figure 4C:
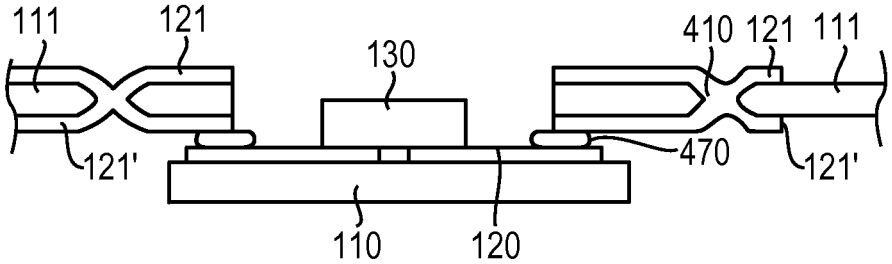
FIG. 4C is a schematic cross-section of a patch repairing a portion of an illumination system below a gap in the illumination system in accordance with embodiments of the invention.

FIG. 4A shows an example of a patch formed over a lighting system, where the failed LEE in the lighting system has been removed, leaving a void 420. The patch includes or consists essentially of replacement LEE 130 having contacts 220 that are electrically coupled using ACA 210 to conductive traces 120 on patch substrate 110. Conductive traces 120 extend through the patch substrate 110 to form one or more vias 410 through patch substrate 110, permitting access to conductive traces 120 from the backside of the patch, as shown in FIG. 4A. A bottom patch contact pad 430 may have an area and/or size larger than via 410 or may be substantially the same size as via 410 or may be smaller in area and/or size than via 410. In FIG. 4A, bottom patch contact pads 430 are electrically coupled to conductive traces 121 using ACA 210'; however, this is not a limitation of the present invention, and in other embodiments other means of electrically coupling bottom patch contact pads 430 to conductive traces 121 may be utilized, for example conductive adhesive, solder, or the like. FIGS. 4B and 4C show two embodiments similar to that shown in FIG. 4A. In the embodiment shown in FIG. 4B, the patch is formed at least partially within void 420 such that patch conductive traces 120 are coplanar or substantially coplanar with substrate conductive traces 121. Conductive bridges 450 electrically couple patch conductive traces 120 to substrate conductive traces 121. Conductive bridges 450 may be implemented in a variety of ways, for example, as conductive adhesive, ACA, solder, conductive material such as a wire or sheet in combination with solder or conductive adhesive, or the like. In some embodiments, the patch may be supported and/or mechanically attached to substrate 111 using an optional base 460. Base 460 may include or consist essentially of the same material as substrate 110 or substrate 110. In some embodiments, base 460 may include or consist essentially of tape or a stiffener and an adhesive for attachment to substrate 111.

In the embodiment shown in FIG. 4C, the patch is formed below void 420 such that patch conductive traces 120 are electrically coupled to back conductive traces 121', which are electrically coupled to conductive traces 121 (on the front of substrate 111) by way of vias 410. Conductive traces 120 may be electrically coupled and or mechanically attached to bottom conductive traces 121' using a conductive bridge 470. Conductive bridge 470 may be implemented in a variety of ways, for example conductive adhesive, ACA, solder, or the like. In some embodiments, the patch may be supported and/or mechanically attached to substrate 111 using optional base 460 (see FIG. 4B; not shown in FIG. 4C).

Figure 5:
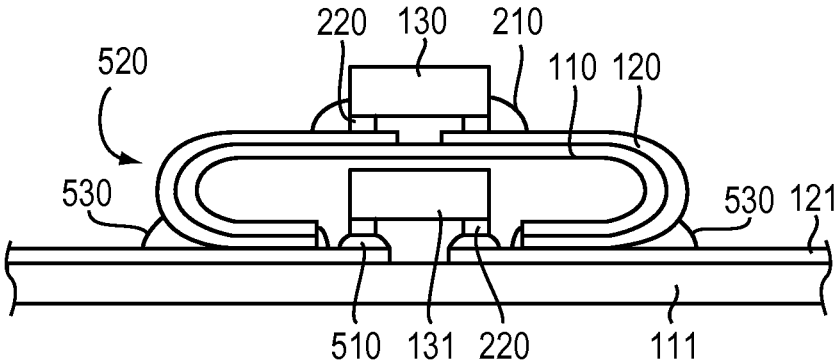
FIG. 5 is a schematic cross-section of a patch having a folded substrate repairing a portion of an illumination system in accordance with embodiments of the invention.

FIG. 5 shows another embodiment of the present invention, in which a portion of substrate 110 and conductive traces 120 are folded over to provide contact between the patch and the conductive traces 121. FIG. 5 shows the patch including or consisting essentially of substrate 110, conductive traces 120, and replacement LEE 130 electrically coupled through contacts 220 to conductive traces 120 with ACA 210. A portion of substrate 110 and conductive traces 120 are folded over in regions 520 to permit electrical coupling to system conductive traces 121 using an ACA 530. Failed LEE 131 is left in place in this example but may be removed in other embodiments. In FIG. 5, failed LEE 131 is electrically coupled to conductive traces 121 using a solder 510; however, this is not a limitation of the present invention, and in other embodiments failed LEE 131 may be electrically coupled to conductive traces 121 using any means. While the fold in region 520 is shown as having a relatively large radius of curvature, this is not a limitation of the present invention, and in other embodiments the fold may include or consist essentially of a crease or relatively small radius of curvature.

Figure 6A:
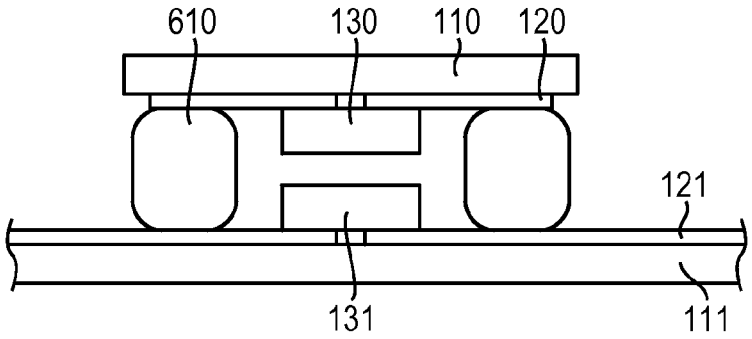
FIG. 6A is a schematic cross-section of a patch repairing a portion of an illumination system in accordance with embodiments of the invention.
Figure 6B:
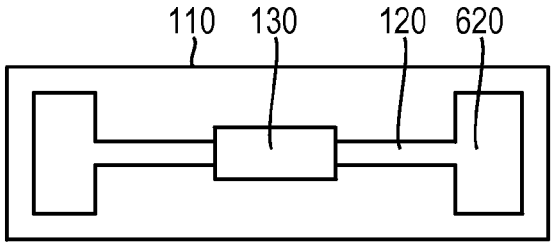
FIG. 6B is a schematic plan view of the patch of FIG. 6A.

FIG. 6A shows an example of one embodiment of the present invention in which the patch is mounted upside-down over failed LEE 131. As shown in FIG. 6A, the replacement LEE 130 is adjacent to and facing the failed LEE 131. In the example shown in FIG. 6A, the patch is electrically coupled using a conductive tape 610; however, this is not a limitation of the present invention, and in other embodiments the patch may be electrically coupled to conductive traces using other means, for example ACA, conductive epoxy, or solder. FIG. 6B is a plan view of the patch structure of FIG. 6A, showing conductive traces 120 attached to pads 620. In this embodiment, substrate 110 is transparent to a wavelength of light emitted by replacement LEE 130. In some embodiments, substrate 110 has a transmissivity greater than 80% to light emitted by replacement LEE 130. As shown in FIG. 6B, in some embodiments, conductive traces 120 on transparent patch substrate 110 are relatively thin so as not to block or absorb light emitted by replacement LEE 130. In some embodiments, conductive traces 120 may have a width ranging from about 10 μm to about 1 mm. In some embodiments, conductive traces 120 may include or consist essentially of silver, gold, copper, aluminum, or the like. In some embodiments, conductive traces 120 may include or consist essentially of a transparent conductor, for example indium tin oxide (ITO) or the like. In some embodiments, all or portions of conductive traces 120 have a transmissivity greater than 80% to light emitted by replacement LEE 130.

Figure 6C:
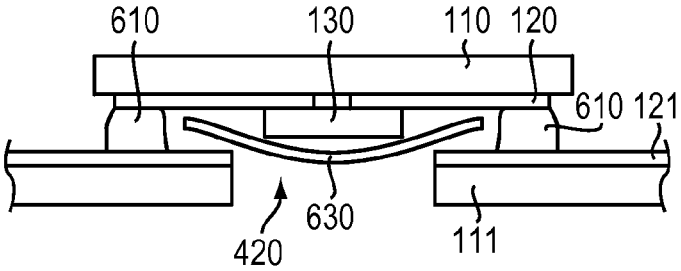
FIGS. 6C-6E are schematic cross-sections of reflectors positioned on repaired illumination systems to redirect light from replacement light-emitting elements in accordance with embodiments of the invention.
Figure 6D:
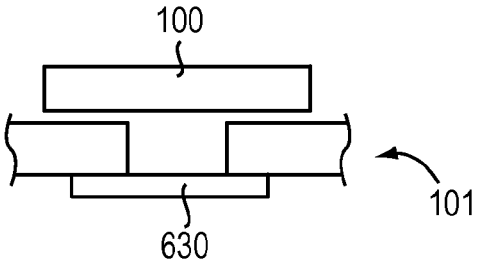
Figure 6E:
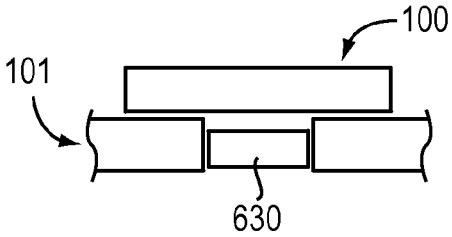

In some embodiments, an optional reflective material 630 may be positioned between replacement LEE 130 and failed LEE 131, or between replacement LEE 130 and the lighting system, when failed LEE 131 is removed, to aid in redirection of light emitted by replacement LEE 130 back up through substrate 110, as shown in FIG. 6C. Reflective material 630 may include or consist essentially of a diffuse or specular reflector, for example polyester, PET or a metal such as silver, gold, aluminum, copper, or the like, or a metal such as silver, gold, aluminum, copper, or the like deposited on a flexible or rigid substrate, for example FR4, PET, polyester, or the like. In some embodiments, reflective material 630 may include or consist essentially of the same material as substrate 110 or conductive trace 120; however, this is not a limitation of the present invention, and in other embodiments reflective material 630 may include or consist essentially of any reflective material. In some embodiments, reflective material 630 has a reflectivity greater than 80% to light emitted by replacement LEE 130. In some embodiments, reflective material 630 may be formed on replacement LEE 130, while in other embodiments reflective material 630 may be formed over but not directly attached to replacement LEE 130. In some embodiments, reflective material 630 may be formed on the side of substrate 111 opposite that on which conductive traces 121 are formed. For example, reflective material 630 may include or consist essentially of a reflective film, layer, or tape formed over void 420 or a reflective plug formed in or partially in void 420, as shown in FIGS. 6D and 6E respectively (in FIGS. 6D and 6E the lighting system is shown schematically as lighting system 101 and the patch is shown schematically as patch 100). FIG. 6C shows an embodiment where the failed LEE has been removed, leaving void 420; however, this is not a limitation of the present invention, and in other embodiments failed LEEs may be left in place.

In some embodiments, ACA may be a liquid or a gel, and may be dispensed on a substrate prior to mating and bonding of an overlying system, for example a patch. However, this is not a limitation of the present invention, and in other embodiments the ACA may be in film or substantially solid form, for example anisotropic conductive film (ACF). In some embodiments, ACF may be used in place of conductive tape discussed herein. For example, in FIGS. 6A and 6C, conductive tape 610 may be replaced with ACF, and in FIG. 4, ACA 210' and/or ACA 210 may be replaced with ACF.

Figure 7A:
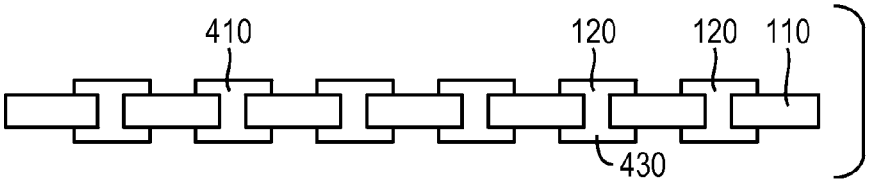
FIGS. 7A-7C are schematic cross-sections of a fabrication process for patches for repair of illumination systems in accordance with various embodiments of the invention.
Figure 7B:
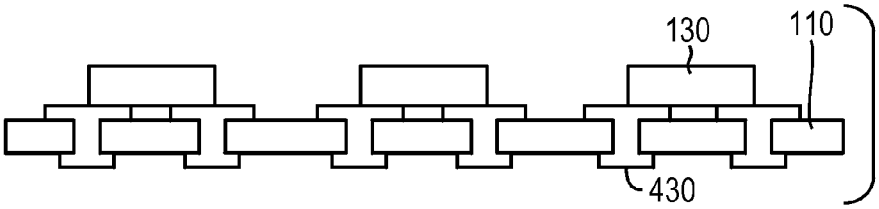
Figure 7C:
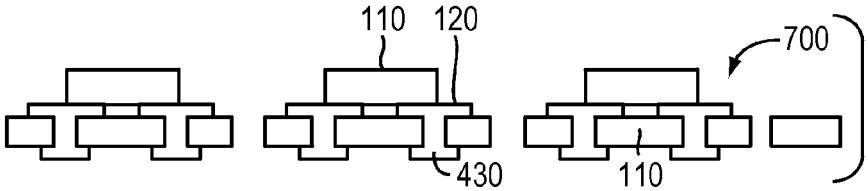

FIGS. 7A-7C show one embodiment for the manufacture of a patch similar to that shown in FIG. 4. FIG. 7A shows a series of patches at an early stage of manufacture. In FIG. 7A, patch substrate 110 has had conductive traces 120 formed over patch substrate 110, and vias 410 formed through patch substrate 110 electrically coupling conductive traces 120 to back contacts 430, which are formed on the side of patch substrate opposite that of conductive traces 120. In some embodiments, patch substrate 110 may be flexible, while in other embodiments, patch substrate 110 may be rigid or substantially rigid. In some embodiments, one or more reflective layer(s) or coating(s) may be formed over the patch substrate 110. For example, the reflective layer may include or consist essentially of a metal, for example gold, silver, aluminum, copper or the like, or a non-conductive material, for example $TiO_2$, or an ink, for example a white or otherwise reflective ink. In some embodiments, the reflective layer may be a solder mask. In some embodiments, the reflective layer may be formed by printing, stencil printing, screen printing, evaporation, sputtering, plating, lamination, chemical vapor deposition, or the like. The type and means of formation of the reflective layer are not limitations of the present invention.

Via 410 may include or consist essentially of, e.g., a crimp-type via or a through-hole that is been filled or partially filled with conductive material. In some embodiments, via 410 may have other configurations, for example a rivet 710 (FIG. 7D) or a staple 720 (FIG. 7E). In some embodiments, the conductive traces and/or via 410 are formed as part of the forming or printing process. In some embodiments, via 410 may be formed in or as part of a roll-to-roll process. In some embodiments, conductive traces 120 may be formed in a roll-to-roll process and the electrical coupling between conductive trace 120 and back contact 430 may be formed in the same or a different roll-to-roll process.

FIG. 7B shows the structure of FIG. 7A at a later stage of manufacture. In FIG. 7B, LEEs 130 have been formed over and electrically coupled to conductive traces 120. As discussed herein, a variety of means may be used for electrically coupling LEEs 130 to conductive traces 120. FIG. 7C shows the structure of FIG. 7B at a later stage of manufacture. In FIG. 7C, the structure of FIG. 7B has been singulated (i.e., separated) into individual patches 700. In some embodiments, singulation may be performed as part of a roll-to-roll process. For example, in some embodiments, the roll-to roll process may start with a roll of film or substrate 110 with conductive traces 120 and optional vias 410 and back contacts 430 formed and the process proceeds by applying a conductive and/or non-conductive adhesive and/or ACA to the sheet in the contact gap area (the gap between two adjacent conductive traces 120), followed by placement of LEE 130 over the adhesive and gap region, followed by curing of the adhesive and singulation into patches. The adhesive may be cured in a variety of ways. In some embodiments, the adhesive curing depends on the type of adhesive used. For example, in some embodiments, the adhesive may be cured by the application of UV radiation, heat, heat and pressure, heat and a magnetic field, time, moisture, or the like. In this way a relatively large number of patches may be fabricated in a bulk or batch process. In some embodiments, the process for making patches described in relation to FIGS. 7A-7C is substantially the same or similar to that used to manufacture the lighting system, for example lighting system 101 as shown in FIG. 1C.

Figure 7D:
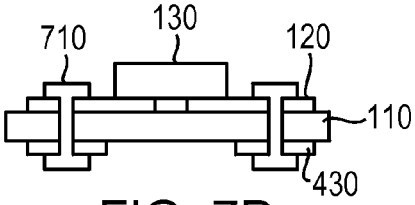
FIGS. 7D-7H are schematic cross-sections of patches for repair of illumination systems in accordance with various embodiments of the invention.
Figure 7E:
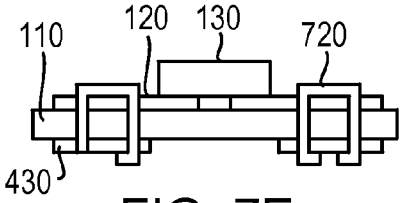
Figure 7F:
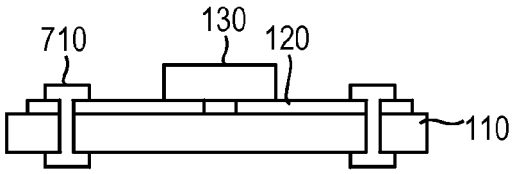

FIG. 7D shows an example of a patch where the electrical coupling between conductive trace 120 and back contact 430 includes or consists essentially of a rivet 710. In some embodiments, the bottom of rivet 710 may serve the purpose of bottom contact 430 and bottom contact 430 may be eliminated, as shown in FIG. 7F.

Figure 7G:
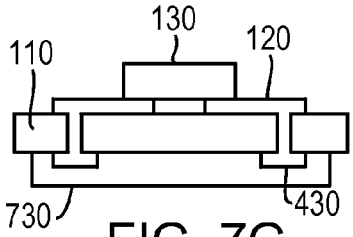
Figure 7H:
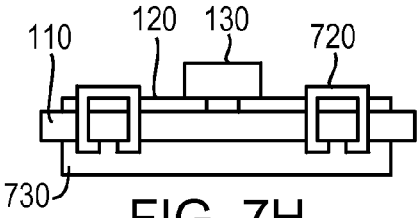

In some embodiments, an adhesive, e.g., a non-conductive adhesive, conductive adhesive, and/or ACA, is pre-applied to the patch before mating with the lighting system. In some embodiments, the adhesive may be applied using a syringe, spray application, brush, or the like. The means by which an adhesive is applied to the patch or the lighting system is not a limitation of the present invention. In some embodiments, an ACF may be applied to all or portions of the bottom of the patch. FIG. 7F shows an example of a patch where the electrical coupling between conductive trace 120 and back contact 430 includes or consists essentially of a rivet 710. In some embodiments ACF 730 may be formed over all or a portion of rivet 710 and all or a portion of substrate 110, either before or after singulation. This results in a patch with the means for electrical and mechanical coupling integrated into the patch, and application of the patch may proceed by placement of the patch over the failed LEE (with optional removal of the failed LEE) and curing of ACF 730. FIGS. 7G and 7H show two examples of a patch with integrated ACF 730; however, these examples are not meant to be limiting, and in other embodiments ACF may be integrated with a wide variety of different patch designs. In some embodiments, ACF 730 may be applied to the patch during the patch fabrication process, for example after the step shown in FIG. 7B, before the structure is singulated to form the individual patches. In some embodiments, this may be done as part of a roll-to-roll process. In some embodiments, a removable liner may be formed over ACF 730 (i.e., over the surface of ACF 730 opposite the patch substrate 110) to protect ACF 730 until the patch is ready to be used, at which time it is removed before application to the lighting system.

Figure 8A:
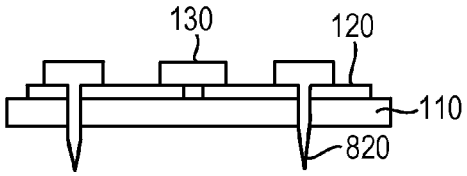
FIGS. 8A-8D are schematic cross-sections of patches having attachment mechanisms in accordance with various embodiments of the invention.
Figure 8B:
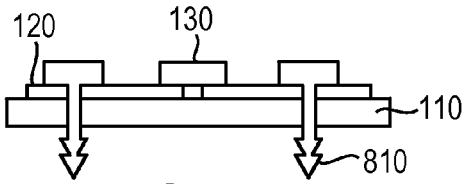
Figure 8C:
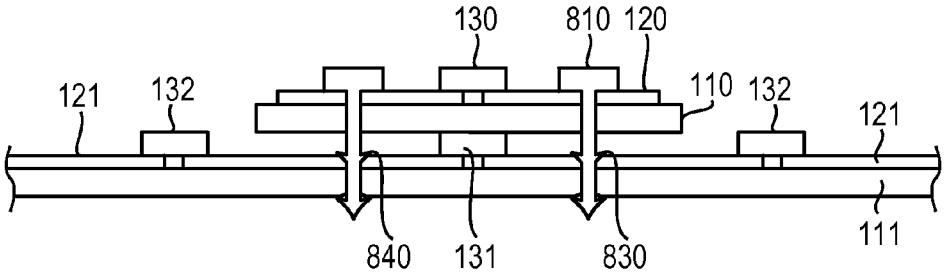
Figure 8D:
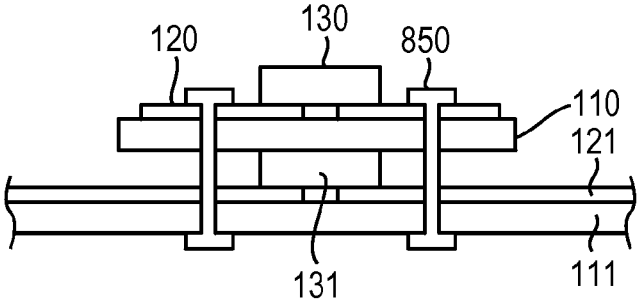

In some embodiments, the patch may include a conductive post or barb or piercing needle that forms at least a portion of the electrical and mechanical coupling to the underlying lighting system by piercing the underlying material and electrically coupling to conductive traces 121 on lighting system 101 (see FIG. 1C). FIGS. 8A and 8B show two embodiments of a patch having a barb 810 or 820; however, the configurations of barbs 810, 820 are not a limitation of the present invention, and in other embodiments the barbs may have different shapes or configurations. FIG. 8C shows one embodiment of a barbed patch attached to a lighting system. As shown in FIG. 8C, the patch is held onto lighting system 101 using barbs 810. In the embodiment shown in FIG. 8C, each barb 810 has one or more tangs that are in contact with conductive traces 121 (tangs 830) and that are in contact with the bottom of substrate 111 (tangs 840). In some embodiments, a rivet 850 may be used to electrically couple and mechanically attach the patch to the lighting system, as shown in FIG. 8D.

Figure 9:
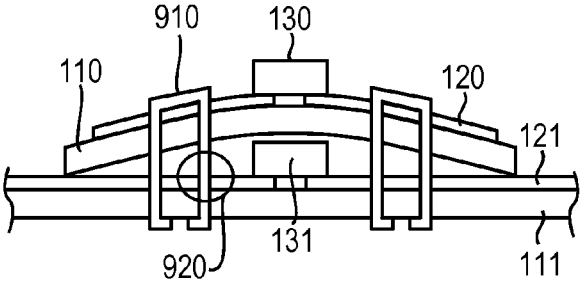
FIG. 9 is a schematic cross-section of a patch attached to an illumination system with staples in accordance with various embodiments of the invention.

In some embodiments, the patch may be attached and/or electrically coupled to the underlying lighting system 101 using staples, as shown in an example in FIG. 9. (As used herein, a "staple" is a conductive attachment mechanism that pierces or extends through a patch substrate and/or an illumination-system substrate at multiple points.) FIG. 9 shows a patch electrically and mechanically coupled to an underlying lighting system 101, where replacement LEE 130 is replacing failed LEE 131. Staples 910 may extend through the patch and underlying lighting system as shown. Electrical coupling between conductive traces 120 on the patch and conductive traces 121 on the lighting system occurs in regions 920.

Figure 10:
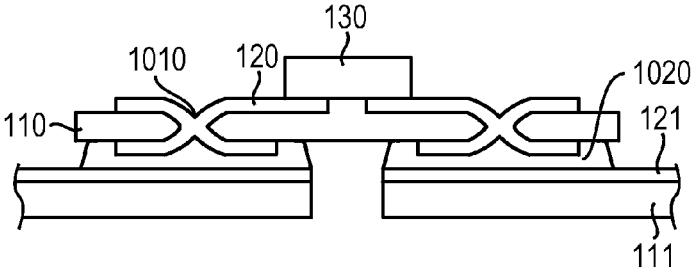
FIG. 10 is a schematic cross-section of a patch attached to an illumination system with conductive adhesive in accordance with various embodiments of the invention.

In some embodiments, the patch may be adhered to and electrically coupled to the underlying lighting system using conductive adhesive, as shown in FIG. 10. FIG. 10 shows a patch adhered to and electrically coupled to an underlying lighting system using a conductive adhesive 1020. In some embodiments, a via 1010 through patch substrate 110 is formed using a crimp system, or is a crimp via. In some embodiments, a crimp via is formed by applying pressure to both sides of the conductive traces on opposites sides of the substrate such that the substrate is deformed and electrical contact is made between conductive traces on opposite sides of the substrate through the substrate or an opening therethrough. In the example shown in FIG. 10, the failed LEE is removed; however, this is not a limitation of the present invention, and in other embodiments conductive adhesive may be used where the failed LEE is left in place. In some embodiments, a non-conductive adhesive or underfill may be formed between the two portions of conductive adhesive 1020. A non-conductive adhesive or underfill between two portions of conductive adhesive 1020 may aid in prevention of electrical conduction between the two portions of conductive adhesive 1020 and/or may aid in adhesion of the patch to the lighting system. Some embodiments may include more than two portions of conductive adhesive 1020 and/or more than one portion of non-conductive adhesive or underfill.

In some embodiments, the conductive traces leading to the failed LEE initially may not be exposed or available for electrical coupling. For example, in some embodiments, the electrical traces may be covered by an insulating film or material, for example an ink or film. In some embodiments, such a covering may serve a variety of purposes, for example to insulate the conductive traces, to protect the conductive traces, or to provide a decorative element or color to the lighting system. In some embodiments, the patch may also bridge or remove the overlying material, for example by removal of a portion of the overlying material or by puncturing a portion of the overlying material. In some embodiments, this may be accomplished using means discussed herein, such as a rivet, staple, barb, or the like (as discussed in reference to FIGS. 8A-8C and FIG. 9). In such embodiments, the staple, barb, rivet, or the like may puncture or penetrate the overlying material and make electrical contact with the underlying conductive trace. In some embodiments, conductive posts or barbs or staples may be combined with other means for electrical and/or mechanical coupling, for example conductive adhesives, non-conductive adhesives, ACA, ACF, or the like.

Figure 11A:
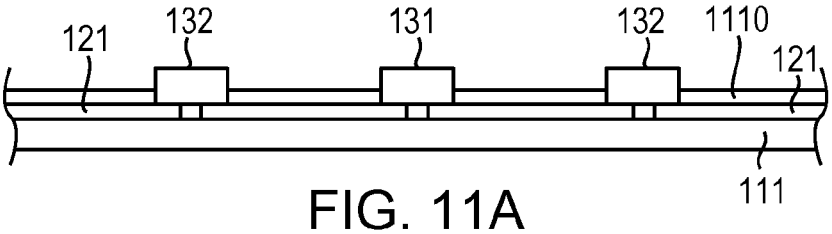
FIGS. 11A-11C are schematic cross-sections of a process for repairing an illumination system having a failed light-emitting element and a cover material disposed over conductive traces in accordance with various embodiments of the invention.
Figure 11B:
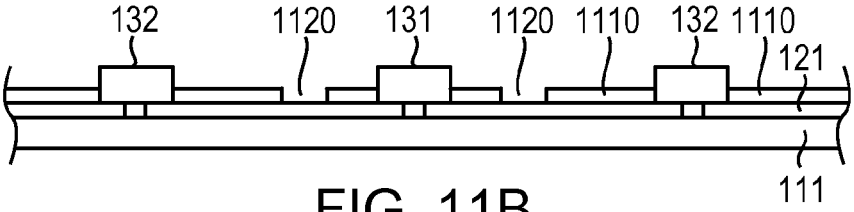
Figure 11C:
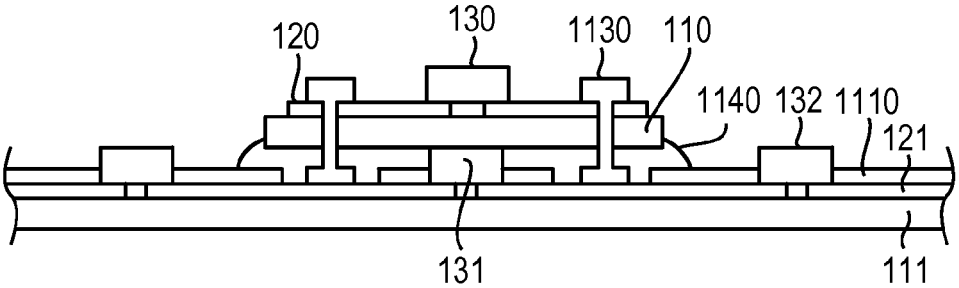

In some embodiments, a portion of the overlying material may be removed prior to application of the patch. For example, FIG. 11A shows an example in which portions of conductive traces 121 in the region of failed LEE 131 are covered by a cover material 1110. FIG. 11B shows the structure of FIG. 11A at a later stage of manufacture. As shown in FIG. 11B, portions of cover material 1110 in the vicinity of failed LEE 131 have been removed to expose portions 1120 of underlying conductive traces 121. FIG. 11C shows the structure of FIG. 11B at a later stage of manufacture, in which a patch has been applied over the failed LEE 131. In this example, the patch includes one or more rivets 1030 that are electrically coupled to exposed conductive traces regions 1120 and mechanically attached to the lighting system using an adhesive 1140. In some embodiments, adhesive 1140 may include or consist essentially of a conductive adhesive, a non-conductive adhesive, and/or an ACA or ACF. While the patch in FIG. 11C is shown including rivets 1030, this is not a limitation of the present invention, and in other embodiments other means may be used to provide electrical conduction from replacement LEE 130 to conductive traces 121. The overlying material 1110 may be removed using a variety of means, for example ablation, laser ablation, laser cutting, knife cutting, scraping, sanding, etching, or the like.

As discussed herein, in some embodiments, it may be desirable to remove failed LEE 131 before application of the patch. In some embodiments, failed LEE 131 may be removed (i.e., disconnected) electrically, but still remain substantially in place physically. In some embodiments, failed LEE 131 may be removed both electrically and physically. Removal of failed LEE 131 may be accomplished using a variety of techniques, including, e.g., ablation, scraping or shearing off failed LEE 131, removal by means of removing the attachment means of LEE 131 to the underlying substrate (for example un-soldering failed LEE 131 or heating to soften an adhesive that is used to attach failed LEE 131), removal of a portion of the underlying conductive traces 121 to electrically isolate failed LEE 131, and removal of failed LEE 131 along with a portion of the underlying conductive traces 121 and substrate 111. In some embodiments, removal of failed LEE 131 along with a portion of conductive trace 121 and substrate 111 may be accomplished by knife cutting, laser cutting, die cutting, punching, or the like. In some embodiments, a punch tool may be used for the removal process. In some embodiments, a spring-loaded punch tool configured to provide the correct amount of force to achieve the desired cutting or punching action may be used, and may be operated by hand or by machine in a semi-automatic or automatic fashion.

The amount of force applied by the spring-loaded punch tool to achieve removal is dependent on both substrate 111 and conductive trace 121 material and thickness, and may be determined without undue experimentation. In some embodiments, the punch tool includes or consists essentially of a hollow punch tool, that cuts out a circular, square or other shaped portion of substrate 111, including failed LEE 131 and optionally a portion of one or more conductive traces 121. While the removed portion has been described as circular or square shaped, this is not a limitation of the present invention, and in other embodiments the removed shape may be rectangular, hexagonal or any shape. In some embodiments, it is desirable to minimize the amount of material removed.

In some embodiments, a layer may be formed between LEE 130 and conductive traces 121 that facilitates subsequent removal if necessary. In some embodiments, this may include or consist essentially of a layer that softens or has a reduction or elimination in adhesion upon a particular treatment, for example heating, UV exposure, or the like.

Figure 12A:
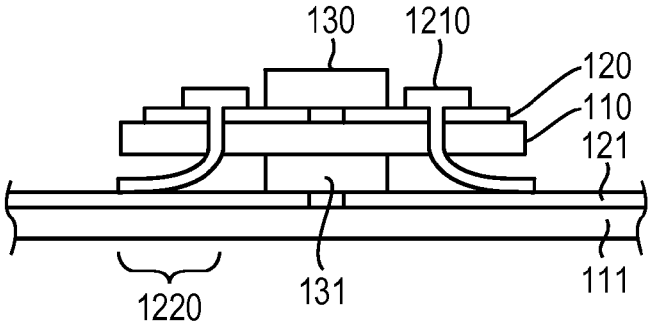
FIGS. 12A and 12B are schematic cross-sections of patches electrically coupled to an underlying illumination system over extended contact areas in accordance with various embodiments of the invention.
Figure 12B:
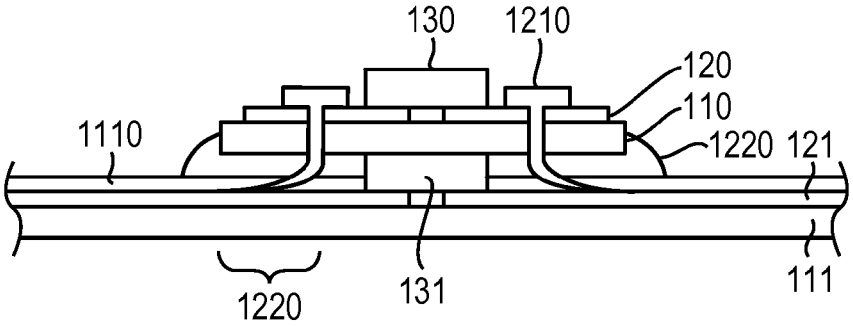

In some embodiments, the conductive posts or barbs are designed to slide and/or extend laterally against portions of conductive traces 121. In some embodiments, this may result in a larger electrical contact area and thus may provide relatively lower contact resistance. FIG. 12A is a schematic illustration showing conductive posts 1210 electrically coupled with conductive traces 121 through a relatively large contact area 1220. In some embodiments, conductive posts 1210 may extend and slide laterally between an overlying material 1110 and conductive traces 121, for example as shown in FIG. 12B. In some embodiments, conductive posts 1210 may each have a sharp point that pierces overlying material 1110 to electrically couple to underlying conductive traces 121, for example as shown in FIG. 12B. FIG. 12B also shows optional adhesive 1220 that may be used to provide enhanced mechanical and/or electrical coupling of the patch to the lighting system. In some embodiments, adhesive 1220 may include or consist essentially of a tape, a conductive tape, a glue, a conductive adhesive, a non-conductive adhesive, ACA, ACF, UV-cured adhesive, thermally cured adhesive, or the like.

In some embodiments, the patch may be aligned to the lighting system and failed LEE 131 manually, for example by optical observation and manual placement of the patch. In some embodiments, the patch or lighting system or both may have one or more alignment features or marks, designed to aid alignment of the patch to the lighting system such that replacement LEE 130 is directly over or substantially over or centered over or substantially centered over failed LEE 131. In some embodiments, the alignment features may include or consist essentially of optical or visual alignment features, designed to aid human and/or machine-vision systems in the location and placement of the patch on the lighting system. In some embodiments, the alignment features may include or consist essentially of mechanical alignment features, designed to aid human and/or machine-vision systems in the location and placement of the patch on the lighting system. In some embodiments, the alignment features may include or consist essentially of electronic or electro/optical alignment features, designed to aid human and/or machine-vision systems in the location and placement of the patch on the lighting system. In some embodiments, one type of alignment feature and/or method may be used, while in other embodiments, a combination of alignment features and/or methods may be used.

In some embodiments, patch substrate 110 may be shaped to provide one or more alignment features that may be used to align to marks, features, or components on the lighting system. In some embodiments, the material constituting one or more conductive traces 120 and/or 121 may be patterned to form one or more alignment marks or features. In some embodiments, such marks, features and/or components may be used to aid visual alignment, while in other embodiments such marks, features and/or components may be used to provide mechanical alignment features.

Figure 13A:
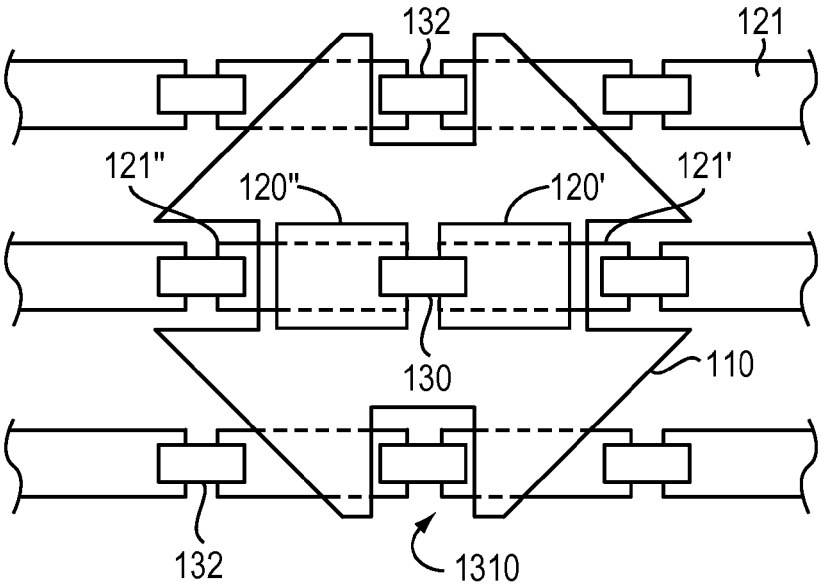
FIG. 13A is a schematic plan view of a patch with alignment cutouts applied to an illumination system in accordance with various embodiments of the invention.

FIG. 13A is a plan-view schematic of a shaped patch substrate 110 having cutouts 1310 that are used to align to nearest-neighbor LEEs 132 on substrate 111. (As used herein, a "cutout" is not necessarily a portion of a substrate that is removed after formation of the substrate, but may be a particular shaped contour of the substrate as it is initially formed.) Failed LEE 131 is directly below replacement LEE 130 and not visible in the schematic of FIG. 13A. Patch conductive traces 120' and 120" are electrically coupled to underlying conductive traces 121' and 121" (the means of electrical coupling in FIG. 13A is not shown for clarity of the other aspects of the illustration). In some embodiments, cutouts 1310 may be used as an aid to visual alignment of the patch to the lighting system, while in other embodiments cutouts 1310 may be used as a mechanical alignment feature to nearest-neighbor LEEs 132, or may be used as a combination of visual and mechanical alignment aids.

Figure 13B:
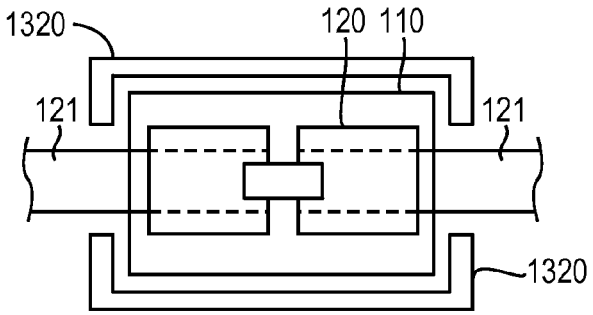
FIG. 13B is a schematic plan view of a portion of an illumination system with an alignment feature in accordance with various embodiments of the invention.

FIG. 13B shows an example of an alignment feature 1320 formed on substrate 111. In some embodiments, the alignment feature 1320 may include or consist essentially of the same material as conductive traces 121 and/or 120; however, this is not a limitation of the present invention, and in other embodiments alignment features 1320 may include or consist of any material, for example a metal, such as gold, silver, copper, aluminum or the like, an ink, a conductive ink, or other materials. In some embodiments, alignment feature 1320 may have a thickness large enough to provide mechanical as well as visual alignment of the patch to the lighting system. That is, the patch may be positioned proximate the alignment feature 1320 and prevented from motion over or past the alignment feature 1320 due to the protrusion of the alignment feature 1320 above the substrate.

In some embodiments, fiducial or alignment marks may be formed, for example by printing or patterning of conductive traces 120, 121, and such fiducial or alignment marks may be used in a semi-automated or automated machine-based vision system for semi-automatic or automatic alignment and positioning of the patch over failed LEE 131.

Figure 13C:
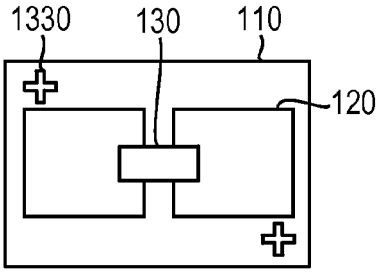
FIGS. 13C-13E are schematic plan views of patches for illumination-system repair having alignment marks in accordance with various embodiments of the invention.
Figure 13D:
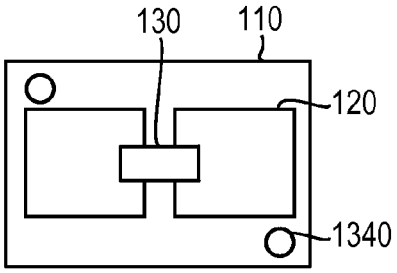

In some embodiments protrusions or bumps and/or holes may be formed in at the patch (for example in substrate 110 and/or conductive traces 120) and/or the lighting system (for example in substrate 111 and/or conductive traces 121), and such holes and/or bumps or protrusions may be used for visual and/or mechanical alignment aids. FIG. 13C shows an example of a patch with an alignment fiducial or mark 1330 formed on substrate 110. While mark 1330 in FIG. 13C is shaped like a plus sign, this is not a limitation of the present invention, and in other embodiments mark 1330 may be circular, square, or it may have any shape. FIG. 13D shows an example of a patch with through-holes 1340 in substrate 110. While FIG. 13D shows through holes 1340 formed only in substrate 110, this is not a limitation of the present invention, and in other embodiments through-holes 1340 may be formed in conductive traces 120 and substrate 110. While the discussion herein has focused on through-hole marks 1340, this is not a limitation of the present invention, and in other embodiments the marks may include or consist essentially of blind holes, i.e., holes that do not extend completely through a material, i.e. substrate 110, 111.

Figure 13E:
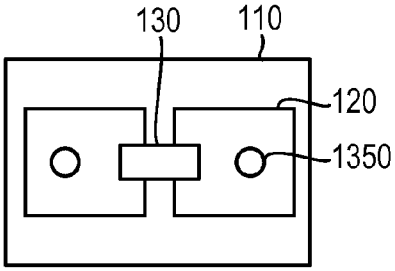
Figure 13F:
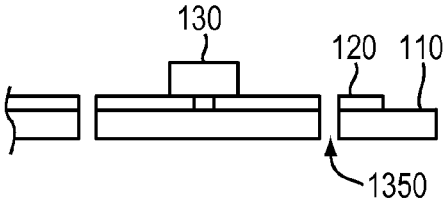
FIG. 13F is a schematic cross-section of the patch of FIG. 13E.
Figure 13G:
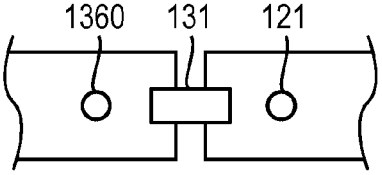
FIG. 13G is a schematic plan view of a portion of an illumination system with alignment marks in accordance with various embodiments of the invention.
Figure 13H:
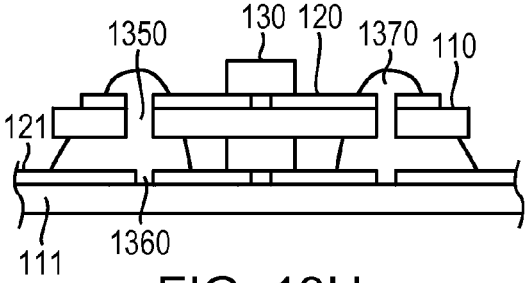
FIG. 13H is a schematic cross-section of a patch and illumination system aligned via respective alignment marks in accordance with various embodiments of the invention.
Figure 13I:
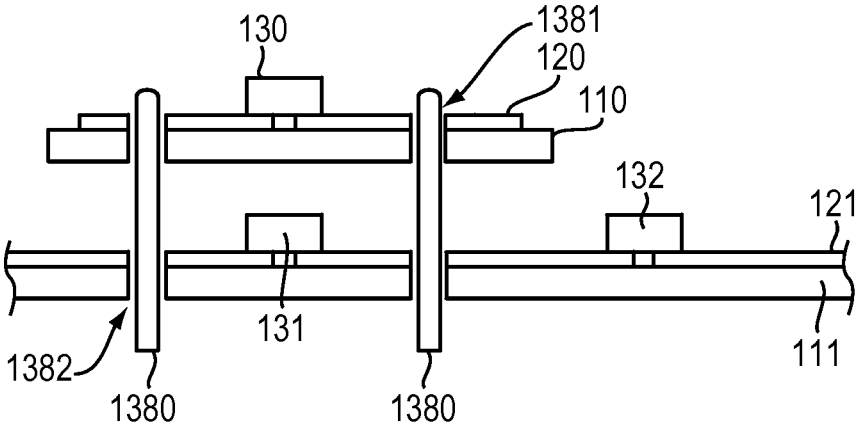
FIG. 13I is a schematic cross-section of a patch aligned to a failed light-emitting element with an alignment tool in accordance with various embodiments of the invention.

FIGS. 13E and 13F are plan-view and cross-sectional depictions of a patch having through-holes 1350 formed through conductive traces 120 and substrate 110. FIG. 13G shows a plan view of one embodiment of conductive trace 121 on the lighting system with alignment marks 1360. Marks 1360 are spaced apart on the lighting system such that the distance between the centers of marks 1360 is substantially the same as the distance between centers of through-holes 1350 on the patch (see FIGS. 13E and 13F). Thus, when the patch is overlaid on the lighting system over failed LEE 131, mark 1360 may be centered within through-hole 1350 to align the patch to failed LEE 131. FIG. 13H shows a cross-sectional view of the patch of FIGS. 13E and 13F applied to the lighting system of FIG. 13G. As shown, mark 1360 is centered with respect to through-hole 1350. In this example, a conductive adhesive 1370 is used to electrically couple patch conductive traces 120 on top of patch substrate 110 to the conductive traces 121 of the lighting system. In some embodiments, conductive adhesive 1370 includes or consists essentially of a UV-cured adhesive, and after alignment and placement of the patch over failed LEE 131, the system is exposed to UV radiation to cure adhesive 1370. In some embodiments, an optional non-conductive adhesive (not shown in FIG. 13H) is formed between adjacent portions of conductive adhesive 1370 to prevent shorting between adjacent conductive traces 121 or between adjacent portions of conductive adhesive 1370. In some embodiments, both patch substrate 110 and lighting system substrate 111 may include through-holes and/or blind holes, and an alignment tool that extends through at least a portion of the holes in patch substrate 110 and lighting system substrate 111 may be used to align replacement LEE 130 with failed LEE 131. FIG. 13I shows an example in which both patch substrate 110 and lighting system substrate 111 include through-holes 1381 and 1382, respectively, and an alignment tool 1380 extends through through-holes 1381, 1382 in patch substrate 110 and lighting system substrate 111 respectively to align the patch with the failed LEE 131.

In some embodiments the alignment marks may be formed in the same step as (e.g., concurrently with) conductive traces 120, 121; however, this is not a limitation of the present invention, and in other embodiments the alignment marks may be formed in a different step. In some embodiments, the alignment marks may be embossed into substrates 110, 111.

Figure 14A:
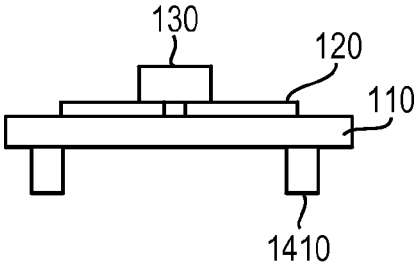
FIGS. 14A and 14B are schematic cross-sections of patches with protrusions to facilitate alignment in accordance with various embodiments of the invention.
Figure 14B:
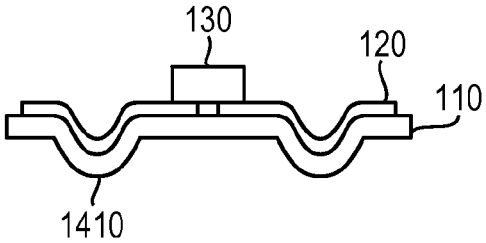
Figure 14C:
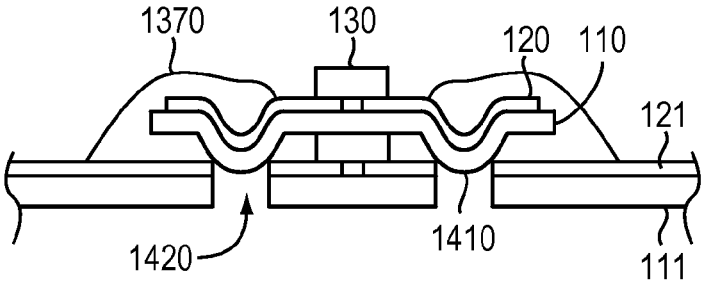
FIG. 14C is a schematic cross-section of protrusions of a patch aligned with receptacles of an illumination system in accordance with various embodiments of the invention.
Figure 14D:
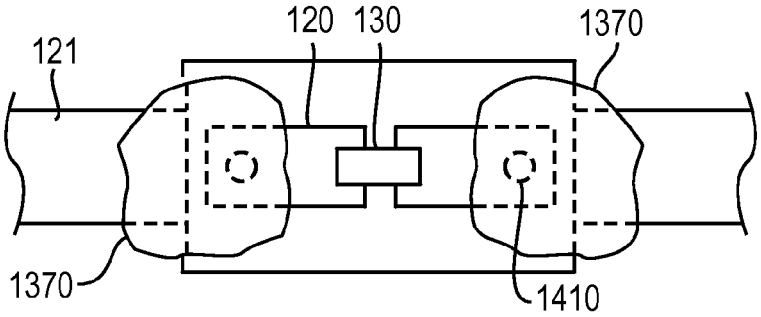
FIG. 14D is a schematic plan view of the aligned patch of FIG. 14C.
Figure 14E:
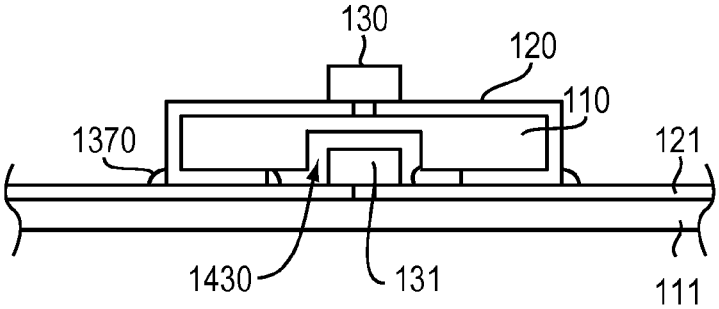
FIG. 14E is a schematic cross-section of a patch having a recess to accommodate all or a portion of a failed light-emitting element in accordance with various embodiments of the invention.

FIGS. 14A and 14B show two examples of embodiments in which patch substrate 110 includes one or more bumps or protrusions 1410. In the embodiment shown in FIG. 14A, bump 1410 is formed separately from substrate 110 (i.e., it is a discrete piece). In some embodiments, bump 1410 may include or consist essentially of the same material as substrate 110; however, this is not a limitation of the present invention, and in other embodiments bump 1410 may include or consist essentially of a material different from substrate 110, or may include or consist essentially of more than one material. In the embodiment shown in FIG. 14B, bump 1410 is formed by a deformation of substrate 110. Such bumps or protrusions may be used to mechanically align the patch to the lighting system and/or failed LEE 131. In some embodiments, the lighting system may include one or more recesses or receptacles 1420 into which the one or more bumps or protrusions may be inserted or partially inserted, as shown in FIG. 14C in cross-sectional view and in FIG. 14D in plan view. In the embodiment shown in FIGS. 14C and 14D, patch conductive trace 120 is electrically coupled to substrate conductive trace 121 using a conductive adhesive 1370; however, this is not a limitation of the present invention, and in other embodiments other means may be used to electrically couple patch conductive trace 120 to substrate conductive trace 121. In the embodiment shown in FIGS. 14C and 14D, receptacles 1420 in substrate 111 include or consist essentially of through-holes; however, this is not a limitation of the present invention, and in other embodiments receptacles 1420 may be blind holes or another form of mating receptacle. In some embodiments, patch substrate 110 may include a through-hole or a blind hole that fits over all or part of failed LEE 131. FIG. 14E shows an embodiment where patch substrate includes a blind hole 1430 that fits over all or a portion of failed LEE 131. In the embodiment shown in FIG. 14E, patch conductive trace 120 is wrapped around a portion of the side and bottom of patch substrate 110, such that it may be electrically coupled to substrate conductive trace 121 using conductive adhesive 1370; however, this is not a limitation of the present invention, and in other embodiments other means may be used to electrically couple patch conductive trace 120 to substrate conductive trace 121.

In some embodiments, electrical/optical alignment may be used to align the patch to the lighting system. For example, in some embodiments, the underlying lighting system may be energized such that all LEEs 132 are illuminated and failed LEE 131 is not illuminated. The patch may then be overlaid on the lighting system and its position adjusted until replacement LEE 130 on the patch is illuminated and in the desired position, at which point the patch is mechanically and/or electrically attached or fixed to the lighting system. In some embodiments, the patch may be mechanically and/or electrically attached or fixed to the lighting system using a relatively fast curing adhesive, for example using a thermally cured adhesive or a UV-cured adhesive. This approach may be used for all types of failures of failed LEEs 131, including short, open, or intermittent.

In some embodiments, LEEs 130, 131, and/or 132 may include or consist essentially of light-emitting diodes (LEDs). In some embodiments, LEEs 130, 131, and/or 132 may emit electromagnetic radiation within a wavelength regime of interest, for example, infrared, visible, for example blue, red, green, yellow, etc. light, or radiation in the UV regime, when activated by passing a current through the device. In some embodiments, LEEs 130, 131, and/or 132 may include a substrate over which the active device layers are formed. The structure and composition of such layers are well known to those skilled in the art. In general, such a layer structure (e.g., for an LED) may include top and bottom cladding layers, one doped n-type and one doped p-type, and one or more active layers (from which most or all of the light is emitted) in between the cladding layers. In some embodiments, the layers collectively may have a thickness in the range of about 0.25 μm to about 10 μm. In some embodiments, the substrate is transparent and all or a portion thereof is left attached to the device layers, while in other embodiments the substrate may be partially or completely removed. In some embodiments, LEE 130 may include or consist essentially of nitride-based semiconductors (for example containing one more of the elements Al, Ga, In, and nitrogen). In some embodiments, LEE 130 may include or consist essentially of nitride-based semiconductors and may emit light in the wavelength range of about 400 nm to about 550 nm.

Figure 15:
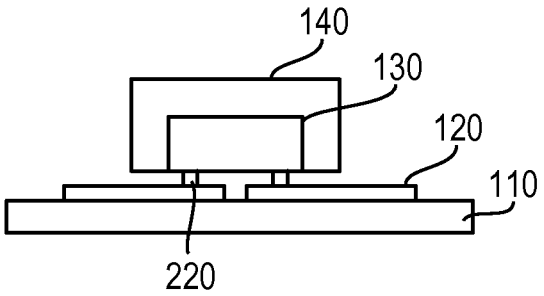
FIG. 15 is a cross-sectional schematic of a white die in accordance with various embodiments of the invention.

In some embodiments, LEEs 130, 131, and/or 132 may be at least partially covered by (or otherwise associate with such that light from the LEE is emitted into) a wavelength-conversion material (also referred to herein as a phosphor), phosphor conversion element (PCE), wavelength conversion element (WCE), or phosphor element (PE), all of which are utilized synonymously herein unless otherwise indicated. In some embodiments, white light may also be produced by combining the short-wavelength radiant flux (e.g., blue light) emitted by a semiconductor LED with long-wavelength radiant flux (e.g., yellow light) emitted by, for example one or more phosphors within the light-conversion material. The chromaticity (or color), color temperature, and color-rendering index are determined by the relative intensities of the component colors. For example, the light color may be adjusted from "warm white" with a correlated color temperature (CCT) of 2700 Kelvin or lower to "cool white" with a CCT of 6500 Kelvin or greater by varying the type or amount of phosphor material. White light may also be generated solely or substantially only by the light emitted by the one or more phosphor particles within the light-conversion material. FIG. 15 shows an example of a patch including or consisting essentially of LEE 130 partially surrounded by light-conversion material 140. In some embodiments, the structure including or consisting essentially of LEE 130 and phosphor 140 may be referred to as a white die. In some embodiments, a white die may be formed by forming light-conversion material 140 over and/or around one or more LEEs 130 and then separating this structure into individual white dies as described in U.S. patent application Ser. No. 13/748,864, filed Jan. 24, 2013, the entirety of which is incorporated by reference herein. However, this is not a limitation of the present invention, and in other embodiments phosphor 140 may be integrated with LEE using a variety of different techniques.

In some embodiments, an LEE may include or consist essentially of a packaged LED, for example a SMD-packaged LED. In some embodiments, the LEE may be attached to the conductive traces using a variety of means, for example including wire bonding, solder, ball bonding, or the like. In some embodiments, a packaged LEE may include or consist essentially of a LED and a light-conversion material. In some embodiments a packaged LEE may include or consist essentially of a LED and a light conversion material, the combination of which produce substantially white light.

Figure 16:
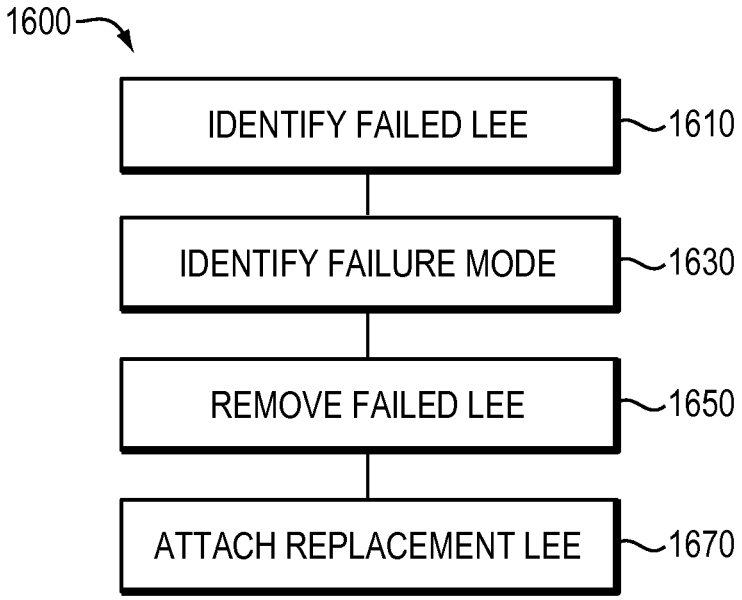
FIG. 16 is a flow chart for a process for repair of an illumination system having one or more failed light-emitting elements in accordance with various embodiments of the invention.

FIG. 16 is a flow chart of a process 1600 for repair of a lighting system. Process 1600 is shown having four steps; however, this is not a limitation of the present invention, and in other embodiments repair processes have more or fewer steps and/or the steps may be performed in different orders. In step 1610, one or more failed LEEs, i.e. LEEs 131, are identified. In an optional step 1630, the failure modes of the one or more failed LEEs 131 are identified. In an optional step 1650, one or more of the failed LEEs 131 are removed. In step 1670, one or more replacement LEEs, i.e. LEEs 130, are attached to the lighting system to replace the one or more failed LEEs 131. Various approaches to process 1600 are discussed below.

In some embodiments, process 1600 may be carried out in a completely manual fashion, for example by hand. In some embodiments, process 1600 may be carried out in a semi-automated fashion, while in other embodiments, process 1600 may be carried out in a fully automated fashion. In some embodiments, the lighting system includes or consists essentially of a light sheet including or consisting of LEEs and conductive traces 121 formed over a flexible substrate 111. In some embodiments, process 1600 may be carried out while the light sheet is still in roll form (i.e., not separated into individual sheets), while in other embodiments, process 1600 may be carried out after the roll is cut into sheets or pieces.

Identifying a failed LEE (step 1610) may be performed alone, or in conjunction with step 1630, identifying the failure mode. For example, in one embodiment all or a portion of the light sheet is energized and an LEE is identified if it does not illuminate. In some embodiments, one or more electrical and/or optical characteristics may be measured, and one or more of these used to determine if the LEE is failed or acceptable. For example, optical parameters that may be determined include light intensity, correlated color temperature (CCT), spectral distribution of the emitted light, color rendering index (CRI), R9, and the like. Furthermore, exemplary electrical parameters that may be determined include forward voltage (of an LEE), drive current, electrical power consumption, and the like. Another parameter that may be measured is the efficiency, for example the optical output power divided by the electrical input power or luminous efficacy. Such testing may be used to provide a pass/fail determination, or to provide additional information, for example the failure mode as identified in step 1630.

In some embodiments, identification of the failure mode may be optional. For example, in the embodiment where failed a LEE 131 will be removed, as shown in step 1650, it may be unnecessary to determine the failure mode. However, in other embodiments, it may only be desired to remove failed LEE 131 if it has a short failure. In this example, the failure mode may be identified in step 1630 and, if it is a short failure, failed LEE 131 may be removed in step 1650. In step 1670, the replacement LEE is attached to the lighting system, replacing failed LEE 131, as discussed herein.

Figure 17:
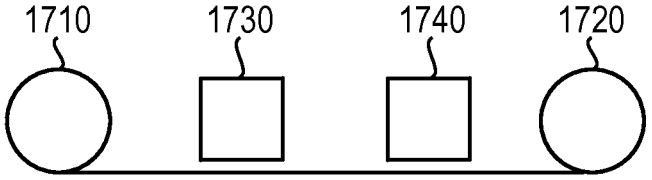
FIG. 17 is a cross-sectional schematic of a roll-to-roll process for repair of an illumination system in accordance with various embodiments of the invention.

FIG. 17 shows an example of a roll-to-roll test system, including or consisting essentially of a supply roll 1710, a take-up roll 1720, a test station 1730, and a repair station 1740. In some embodiments, steps 1610 and/or 1630 of process 1600 may take place at test station 1730, while steps 1650 and/or 1670 of process 1600 may take place at station 1740. In some embodiments, supply roll 1710 supports a portion of a roll of light sheet material that is supplied to test station 1730 and/or repair station 1740, while the repaired light sheet is taken up on take-up roll 1720. While FIG. 17 shows both a test station 1730 and a repair station 1740, this is not a limitation of the present invention and in other embodiments testing and repair may be done separately. In some embodiments, a roll of patch material is supplied to repair station 1740 (for example similar to that shown in FIG. 7B), and the patch material is singulated as needed for repairs, while in other embodiments pre-singulated patches are supplied to repair station 1740.

Figure 18A:
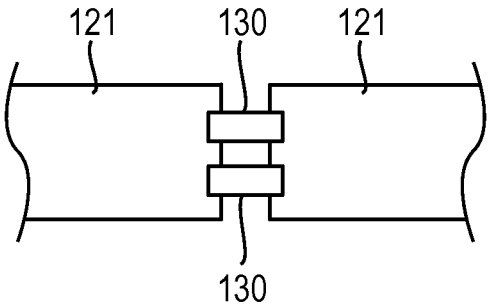
FIGS. 18A and 18B are plan-view schematics of light-emitting elements spanning a gap between conductive traces in accordance with various embodiments of the invention.
Figure 18B:
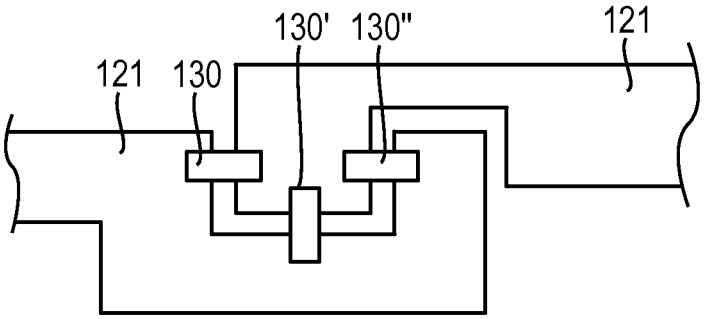

In some embodiments, conductive trace 121 may be designed to permit the formation of additional LEEs 130 without the need for prior removal of a failed LEE 131. FIG. 18A shows an embodiment of conductive traces 121 having a width large enough to permit formation of at least two LEEs 130 substantially side by side and spanning the gap between the traces 121. FIG. 18B shows an embodiment of conductive traces 121 shaped to permit the positioning of three LEEs 130, 130', and 130" in relatively close proximity. The layouts and number of LEEs that may be positioned in close proximity is not a limitation of the present invention.

Figure 18C:
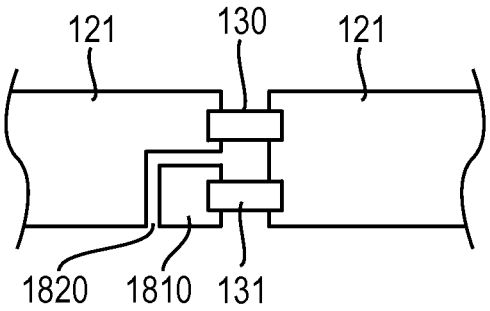
FIG. 18C is a plan-view schematic of a light-emitting element electrically isolated from a conductive trace in accordance with various embodiments of the invention.

FIG. 18C shows an example of an embodiment where a failed LEE 131 has been electrically removed from the circuit with a cut 1820, resulting in an isolated portion 1810 of conductive trace 121. Because conductive trace portion 1810 is isolated from other conductive traces 121, the failed LEE 131 is electrically disconnected from the circuit, and thus even if it is a short failure, it will not affect the performance of replacement LEE 130. In some embodiments, cut 1820 may be performed manually, while in other embodiments it may be performed in an automated fashion, for example as part of the system discussed with reference to FIG. 17. Cut 1820 may be made using a variety of means, for example including laser cutting, knife cutting, ablation, etching, or the like. The method of making cut 1820 is not a limitation of the present invention. While cut 1820 in FIG. 18C is shown as having substantially straight-line segments, this is not a limitation of the present invention, and in other embodiments cut 1820 may have any shape that results in portion 1810 being electrically isolated from the remaining traces 121.

Figure 19A:
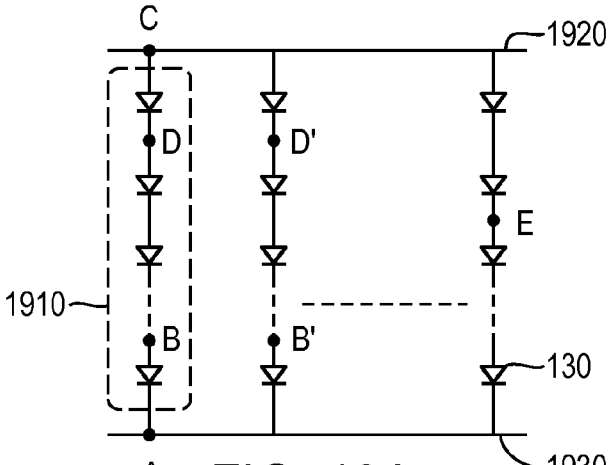
FIGS. 19A and 19B are schematic circuit diagrams of illumination systems in accordance with various embodiments of the invention.
Figure 19B:
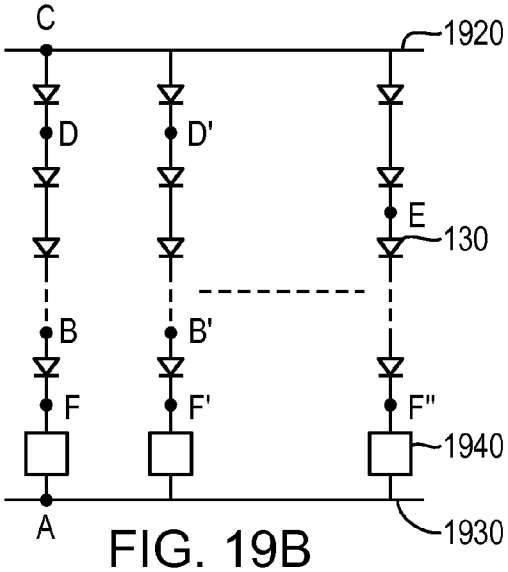
Figure 19C:
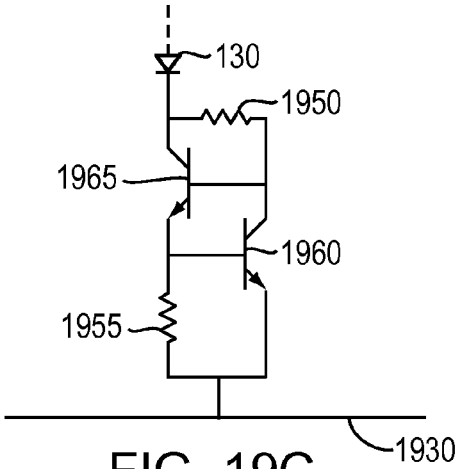
FIG. 19C is a schematic circuit diagram of a current control element in accordance with various embodiments of the invention.

In some embodiments, the lighting system may include an array of LEEs. FIG. 19A shows one embodiment of such an array, including or consisting of one or more strings of LEEs 1910, each of which includes or consists essentially of one or more LEEs 130 electrically coupled in parallel. While FIG. 19A shows strings 1910 electrically coupled in parallel between conductors 1920 and 1930, this is not a limitation of the present invention, and in other embodiments strings 1910 may be electrically coupled in series, or in series/parallel configurations or in any configuration. While FIG. 19A shows strings 1910 including or consisting essentially of series-connected LEEs 130, this is not a limitation of the present invention, and in other embodiments LEEs 130 may be electrically coupled in parallel or in series/parallel configurations or in any configuration. In some embodiments, each light-emitting string 1910 may include a current control element 1940, as shown in FIG. 19B or as described in U.S. patent application Ser. No. 13/799,807, filed Mar. 13, 2013, and/or U.S. patent application Ser. No. 13/965,392, filed Aug. 13, 2013, the entire disclosure of each of which is incorporated by reference herein. In some embodiments, the system of FIG. 19B may be energized using a constant or substantially constant voltage applied between conductor 1920 and conductor 1930. For example, in the structure shown in FIG. 19B, current control elements 1940 may act to provide a substantially constant current to LEEs 130 in each string. FIG. 19C shows one embodiment of a current control element 1940 that includes two transistors 1960, 1965 and two resistors 1950, 1955. In other embodiments, current control element 1940 may include or consist essentially of a resistor or an integrated circuit. The specific components constituting current control element 1940 are not a limitation of the present invention.

In some embodiments, the systems shown in FIGS. 19A and 19B may include a relatively small number of light-emitting strings 1910, for example, about 10 light-emitting strings 1910 or about 30 light-emitting strings 1910. In some embodiments, the systems depicted in FIGS. 19A and 19B may include a relatively large number of light-emitting strings 1910, for example about 100 or about 500 or even more light-emitting strings 1910. In some embodiments, the systems shown in FIGS. 19A and 19B may be manufactured in a roll-to-roll configuration and may be hundreds of meters long and may include thousands or tens of thousands of light-emitting strings 1910. The size of the system or the number of light-emitting strings is not a limitation of the present invention.

As may be understood from an examination of FIGS. 19A and 19B, if these systems include a large number of light-emitting strings 1910, it may be undesirable or difficult to energize all of the strings simultaneously for testing. As may also be seen from an examination of FIGS. 19A and 19B, application of power to conductors 1920 and 1930 generally does not permit the energizing of only some strings 1910 but not others. In some embodiments, the test system may only be able to accommodate a relatively smaller number of LEEs than are in the entire array. In some embodiments, where the system is very large, it may not be practical or possible to energize the entire system, and the individual sheets of strings may be tested once separated or cut to the appropriate size and number of strings.

Referring back to FIG. 19A, one embodiment of the present invention that permits energizing and testing of only one or a fixed number strings in a very large array (or even an infinite array) is described. As may be seen from an examination of FIG. 19A, point C is electrically equivalent to any point on conductor 1920, while point A is electrically equivalent to any point on conductor 1930. One string may be tested by first applying power between points C and B and then between points A and D. Applying power between points C and B permits testing of all of the LEEs in the string except for the LEE between points A and B. In this way, the LEE(s) between points A and B isolates the string from the rest of the system, and only LEEs between points C and B are energized. Similarly, applying power between points A and D permits testing of all of the LEEs in the string except for the LEE(s) between points C and D. In this way, using two tests per string, all LEEs 130 within a string may be energized and tested. It should be noted that the selection of points B and D within the string is arbitrary. A similar approach may be used for other dividing points. For example the LEEs between points C and E may be tested by applying power to conductor 1920 (point C) and point E, while the remaining LEEs in that string may be tested by applying power to point E and point 1930 (point A). In the first example, all LEEs except one are tested twice, while in the second example there is no overlap and each LEE in the string is tested once.

As may be seen from FIG. 19A, more than one string may be tested simultaneously. For example, applying power between points C and B and C and B' permits testing of all of the LEEs in the respective string except for the LEEs between points A and B and between A and B'. In this way, several or more portions of strings may be energized and tested simultaneously.

Electrical connection to the various points in the array may be made in a number of ways, for example needle probes, bed of nail probes, or the like. The method of electrical connection to the system is not a limitation of the present invention.

Referring now to FIG. 19B, current control element 1940, depending on its exact configuration, may or may not allow the energizing approach detailed above with respect to the system shown in FIG. 19A. If current control element 1940 does not permit energization by application of power to conductor 1930 (through current control element 1940), current control element 1940 may be eliminated from the circuit by first energizing and testing between points C and F and then between points B and D. Alternately, as discussed above, energizing and testing may proceed by application of power first between points C and E and then between points F" and E. While FIG. 19B shows current control element 1940 at the end of the string, adjacent to conductor 1930, this is not a limitation of the present invention, and in other embodiments current control element 1940 may have any position within the string, and testing may be accomplished by excluding or including current control element 1940 from the test circuit.

In some embodiments, testing may include energizing LEEs 130 between various points and determining if any LEEs 130 are not emitting any light. This may be done visually, by a person, or using one or more detector or camera systems. In some embodiments, energizing may include or consist essentially of applying a fixed or variable current between the points discussed above or a fixed or variable voltage between the points discussed above. In another embodiment, photometric characteristics, for example color temperature, light output power, color rendering index, or the like may be measured, for example using an integrating sphere, fiber optic, camera, or the like. The specific measurement method is not a limitation of the present invention.

In some embodiments, a combination of two or more methods described herein for electrical and/or mechanical coupling of a patch to the lighting system may be utilized. While the discussion herein has been substantially in reference to patches including or consisting essentially of a replacement LEE 130 that is substantially the same as a failed LEE 131, this is not a limitation of the present invention, and in other embodiments the patch may include or consist essentially of more than one replacement LEE 130 where at least one replacement LEE 130 is different from the failed LEE 131. While the discussion herein has been substantially in reference to patches including or consisting essentially of one replacement LEE 130, this is not a limitation of the present invention, and in other embodiments the patch may include or consist essentially of more than one replacement LEE 130. While the discussion herein has been substantially in reference to a patch replacing one failed LEE 131, this is not a limitation of the present invention, and in other embodiments the patch may simultaneously replace more than one failed LEE 131. While the discussion herein has been substantially in reference to patches applied to lighting systems, this is not a limitation of the present invention and in other embodiments the patch may include or consist essentially of one or more optoelectronic devices and be applied to light-emitting or light-absorbing systems.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A lighting system comprising:

a substrate;

disposed on the substrate, a plurality of spaced-apart conductive traces defining a plurality of gaps therebetween;

a plurality of light-emitting elements disposed over the substrate, each light-emitting element being disposed within a gap and electrically connected to the conductive traces defining the gap;

first and second power conductors disposed over the substrate;

a fault location defined by a gap between two conductive traces either (i) lacking a light-emitting element therein or (ii) comprising an inoperative light-emitting element therein; and disposed over or under the substrate at the fault location, a patch comprising (i) a patch substrate, (ii) two conductive traces disposed on the patch substrate, and (iii) a replacement light-emitting element electrically coupled to the two conductive traces of the patch, wherein (i) the conductive traces of the patch are each electrically connected to one of the conductive traces defining the fault location, thereby electrically connecting the replacement light-emitting element across the fault location, and (ii) the conductive traces on the substrate and light-emitting elements are organized in a plurality of light-emitting strings, each light-emitting string (a) comprising a plurality of series-connected light-emitting elements spanning gaps between conductive traces on the substrate, (b) having a first end electrically coupled to the first power conductor, and (c) having a second end electrically coupled to the second power conductor.

2. The lighting system of claim 1, wherein the replacement light-emitting element comprises a bare-die light-emitting diode.

3. The lighting system of claim 1, wherein the replacement light-emitting element comprises a packaged light-emitting diode.

4. The lighting system of claim 1, wherein the fault location comprises an inoperative light-emitting element therein.

5. The lighting system of claim 4, wherein the inoperative light-emitting element is electrically isolated from at least one of the conductive traces at the fault location.

6. The lighting system of claim 4, wherein (i) the patch substrate defines a recess and (ii) at least a portion of the inoperative light-emitting element is disposed in the recess.

7. The lighting system of claim 1, wherein the fault location lacks a light-emitting element therein.

8. The lighting system of claim 7, wherein the substrate defines a hole therethrough in the fault location.

9. The lighting system of claim 1, wherein the replacement light-emitting element comprises two spaced-apart contacts each electrically coupled to one of the conductive traces on the patch substrate via at least one of a conductive adhesive, an anisotropic conductive adhesive, or an anisotropic conductive film.

10. The lighting system of claim 1, wherein the conductive traces on the patch substrate are each electrically coupled to one of the conductive traces defining the fault location via at least one of a conductive adhesive, an anisotropic conductive adhesive, an anisotropic conductive film, a conductive tape, or a solid conductive fastener.

11. The lighting system of claim 1, wherein at least one of the substrate or the patch substrate comprises at least one alignment feature for facilitating alignment of the patch to the fault location.

12. The lighting system of claim 11, wherein the alignment feature comprises at least one of an alignment mark, a recess, a hole, a blind hole, or a protrusion.

13. The lighting system of claim 1, wherein (i) the two conductive traces of the patch are disposed on a first surface of the patch substrate, (ii) the patch substrate comprises an additional two conductive traces on a second surface of the patch substrate opposite the first surface, and (iii) the two conductive traces of the patch are electrically coupled to the conductive traces defining the fault location via the two additional conductive traces on the second surface of the patch substrate.

14. The lighting system of claim 13, wherein the two additional conductive traces on the second surface of the patch substrate are each electrically coupled to one of the conductive traces defining the fault location via at least one of a conductive adhesive, a conductive tape, an anisotropic conductive adhesive, or a anisotropic conductive film.

15. The lighting system of claim 1, wherein the replacement light-emitting element is disposed between the patch substrate and the substrate.

16. The lighting system of claim 1, wherein the patch substrate is disposed between the replacement light-emitting element and the substrate.

17. The lighting system of claim 1, wherein (i) the substrate has first and second opposing surfaces, (ii) the light-emitting elements and conductive traces are disposed over the first surface of the substrate, and (iii) the patch is disposed over the first surface of the substrate.

18. The lighting system of claim 1, wherein (i) the substrate has first and second opposing surfaces, (ii) the light-emitting elements and conductive traces are disposed over the first surface of the substrate, and (iii) the patch is disposed over the second surface of the substrate.

19. The lighting system of claim 1, wherein the patch substrate comprises at least one of polyethylene naphthalate, polyethylene terephthalate, polycarbonate, polyethersulfone, polyester, polyimide, polyethylene, fiberglass, metal-core printed circuit board, metal foil, silicon, or paper.

20. The lighting system of claim 1, wherein at least one of the conductive traces on the substrate or the conductive traces on the patch comprise at least one of gold, silver, copper, aluminum, chromium, carbon, silver ink, or copper ink.

21. The lighting system of claim 1, wherein the light-emitting elements emit substantially white light.

22. The lighting system of claim 1, wherein (i) the conductive traces on the patch substrate are disposed on a first surface of the patch substrate, and (ii) only portions of the patch substrate are folded such that the conductive traces are electrically coupled to the conductive traces defining the fault location therebelow.

23. The lighting system of claim 1, further comprising a reflective layer (i) reflective to a wavelength of light emitted by the replacement light-emitting element, and (ii) positioned to reflect light emitted by the replacement light-emitting element in a direction of light emitted by the light-emitting elements on the substrate.

24. A method for repairing a lighting system comprising (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap, the method comprising:

identifying a fault location defined by a gap between two conductive traces either (i) lacking a light-emitting element therein or (ii) comprising an inoperative light-emitting element therein;

disposing over or under the substrate at the fault location a patch comprising (i) a patch substrate, (ii) two conductive traces disposed on the patch substrate, and (iii) a replacement light-emitting element electrically coupled to the two conductive traces of the patch; and electrically connecting the replacement light-emitting element across the fault location by electrically connecting each of the conductive traces of the patch to one of the conductive traces defining the fault location, wherein the conductive traces and light-emitting elements on the substrate are organized in a plurality of light-emitting strings, each light-emitting string (i) comprising a plurality of series-connected light-emitting elements spanning gaps between conductive traces, (ii) having a first end electrically coupled to a first power conductor, and (ii) having a second end electrically coupled to a second power conductor different from the first power conductor.

25. The method of claim 24, wherein identifying the fault location comprises applying power to at least some of the light-emitting elements.

26. The method of claim 24, wherein identifying the fault location comprises applying power to each light-emitting element in each light-emitting string.

27. The method of claim 26, wherein power is applied twice to one or more, but not all, light-emitting elements in each light-emitting string.

28. The method of claim 24, wherein identifying the fault location comprises electrically contacting (i) the first power conductor and (ii) a conductive trace on the substrate within a light-emitting string but not physically connected to the first or second power connectors.

29. The method of claim 24, wherein identifying the fault location comprises measuring an optical characteristic of a light-emitting element disposed at the fault location.

30. The method of claim 29, wherein the optical characteristic comprises at least one of light output power, wavelength, color temperature, color rendering index, efficiency, or luminous efficacy.

31. The method of claim 24, wherein identifying the fault location comprises measuring an electrical characteristic of a light-emitting element disposed at the fault location.

32. The method of claim 31, wherein the electrical characteristic comprises at least one of forward voltage or reverse leakage voltage.

33. The method of claim 24, wherein each of the conductive traces of the patch are electrically connected to one of the conductive traces defining the fault location via at least one of a conductive adhesive, a conductive tape, an anisotropic conductive adhesive, an anisotropic conductive film, or a solid conductive fastener.

34. The method of claim 24, wherein an inoperative light-emitting element is disposed at the fault location, and further comprising, after identifying the fault location, electrically isolating the inoperative light-emitting element from at least one of the conductive traces at the fault location.

35. The method of claim 34, wherein electrically isolating the inoperative light-emitting element comprises removing the inoperative light-emitting element from the lighting system.

36. The method of claim 35, further comprising removing a portion of the substrate at the fault location and removing portions of the conductive traces at the fault location.

37. The method of claim 34, wherein electrically isolating the inoperative light-emitting element comprises removing a portion of the at least one conductive trace proximate the fault location.

38. The method of claim 24, wherein identifying the fault location, disposing the patch, and electrically connecting the replacement light-emitting element are performed in a roll-to-roll process.

39. A patch for repairing a fault location on a lighting system, the lighting system comprising (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap, the fault location being defined by a gap between two conductive traces either (i) lacking a light-emitting element therein or (ii) comprising an inoperative light-emitting element therein, the patch comprising:

a patch substrate;

two conductive traces disposed on the patch substrate;

a replacement light-emitting element electrically coupled to the two conductive traces of the patch, wherein the conductive traces of the patch are each electrically connectable to one of the conductive traces of the lighting system defining the fault location to thereby electrically connect the replacement light-emitting element across the fault location; and two conductive barbs, each barb being (i) in electrical contact with and extending from one of the conductive traces on the patch substrate and (ii) configured to penetrate through a conductive trace on the substrate and at least a portion of the substrate therebelow, thereby electrically and mechanically connecting the patch to the lighting system.

40. The patch of claim 39, wherein the patch substrate is sized and shaped to be disposed over or under the fault location without overlying or underlying a light-emitting element of the lighting system not disposed at the fault location.

41. The patch of claim 39, wherein each barb is configured to penetrate entirely through the substrate.

42. A method for repairing a lighting system comprising (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap, the method comprising:

identifying a fault location defined by a gap between two conductive traces comprising an inoperative light-emitting element therein;

removing the inoperative light-emitting element from the lighting system;

removing at least one of a portion of the substrate at the fault location or a portion of a conductive trace proximate the fault location;

disposing over or under the substrate at the fault location a patch comprising (i) a patch substrate, (ii) two conductive traces disposed on the patch substrate, and (iii) a replacement light-emitting element electrically coupled to the two conductive traces of the patch; and electrically connecting the replacement light-emitting element across the fault location by electrically connecting each of the conductive traces of the patch to one of the conductive traces defining the fault location.

43. The method of claim 42, wherein identifying the fault location comprises applying power to at least some of the light-emitting elements.

44. The method of claim 42, wherein identifying the fault location comprises measuring an optical characteristic of a light-emitting element disposed at the fault location.

45. The method of claim 44, wherein the optical characteristic comprises at least one of light output power, wavelength, color temperature, color rendering index, efficiency, or luminous efficacy.

46. The method of claim 42, wherein identifying the fault location comprises measuring an electrical characteristic of a light-emitting element disposed at the fault location.

47. The method of claim 46, wherein the electrical characteristic comprises at least one of forward voltage or reverse leakage voltage.

48. The method of claim 42, wherein each of the conductive traces of the patch are electrically connected to one of the conductive traces defining the fault location via at least one of a conductive adhesive, a conductive tape, an anisotropic conductive adhesive, an anisotropic conductive film, or a solid conductive fastener.

49. A method for repairing a lighting system comprising (i) a substrate, (ii) disposed on the substrate, a plurality of spaced-apart conductive traces defining a plurality of gaps therebetween, and (iii) a plurality of light-emitting elements disposed over the substrate, each light-emitting element being disposed within a gap and electrically connected to the conductive traces defining the gap, the method comprising:

identifying a fault location defined by a gap between two conductive traces comprising an inoperative light-emitting element therein;

removing the inoperative light-emitting element from the lighting system;

disposing over or under the substrate at the fault location a patch comprising (i) a patch substrate, (ii) two conductive traces disposed on the patch substrate, and (iii) a replacement light-emitting element electrically coupled to the two conductive traces of the patch; and electrically connecting the replacement light-emitting element across the fault location by electrically connecting each of the conductive traces of the patch to one of the conductive traces defining the fault location, wherein identifying the fault location, disposing the patch, and electrically connecting the replacement light-emitting element are performed in a roll-to-roll process.

50. A method for repairing a lighting system comprising (i) a substrate, (ii) disposed on the substrate, a plurality of spaced-apart conductive traces defining a plurality of gaps therebetween, and (iii) a plurality of light-emitting elements disposed over the substrate, wherein the conductive traces and light-emitting elements on the substrate are organized in a plurality of light-emitting strings, each light-emitting string (a) comprising a plurality of series-connected light-emitting elements spanning gaps between conductive traces, (b) having a first end electrically coupled to a first power conductor, and (c) having a second end electrically coupled to a second power conductor different from the first power conductor, the method comprising:

identifying a fault location defined by a gap between two conductive traces either (i) lacking a light-emitting element therein or (ii) comprising an inoperative light-emitting element therein, wherein identifying the fault location comprises (a) applying power to each light-emitting element in each light-emitting string and (b) applying power twice to one or more, but not all, light-emitting elements in each light-emitting string; and electrically connecting a replacement light-emitting element to the conductive traces defining the fault location.

51. The method of claim 50, wherein an inoperative light-emitting element is disposed at the fault location, and further comprising, after identifying the fault location, electrically isolating the inoperative light-emitting element from at least one of the conductive traces at the fault location.

52. The method of claim 51, wherein electrically isolating the inoperative light-emitting element comprises removing the inoperative light-emitting element from the lighting system.

53. The method of claim 52, further comprising removing at least one of a portion of the substrate at the fault location or a portion of a conductive trace proximate the fault location.

54. The method of claim 51, wherein electrically isolating the inoperative light-emitting element comprises removing a portion of at least one conductive trace proximate the fault location.

55. The method of claim 50, wherein identifying the fault location and electrically connecting the replacement light-emitting element are performed in a roll-to-roll process.

56. The method of claim 50, wherein identifying the fault location comprises electrically contacting (i) the first power conductor and (ii) a conductive trace on the substrate within a light-emitting string but not physically connected to the first or second power connectors.

57. The method of claim 50, wherein identifying the fault location comprises measuring an optical characteristic of a light-emitting element disposed at the fault location.

58. The method of claim 57, wherein the optical characteristic comprises at least one of light output power, wavelength, color temperature, color rendering index, efficiency, or luminous efficacy.

59. The method of claim 50, wherein identifying the fault location comprises measuring an electrical characteristic of a light-emitting element disposed at the fault location.

60. The method of claim 59, wherein the electrical characteristic comprises at least one of forward voltage or reverse leakage voltage.

61. The method of claim 50, wherein the replacement light-emitting element is electrically connected to the conductive traces defining the fault location via at least one of a conductive adhesive, a conductive tape, an anisotropic conductive adhesive, an anisotropic conductive film, or a solid conductive fastener.

* * * * *